US011538309B2

(12) United States Patent
Coppola et al.

(10) Patent No.: US 11,538,309 B2
(45) Date of Patent: Dec. 27, 2022

(54) INTEGRATING A WHEEL BETWEEN REELS OF A SLOT GAME

(71) Applicant: Aristocrat Technologies, Inc., Las Vegas, NV (US)

(72) Inventors: Roberto Coppola, Las Vegas, NV (US); Rex Carlson, Henderson, NV (US)

(73) Assignee: ARISTOCRAT TECHNOLOGIES, INC., Las Vegas, NV (US)

( * ) Notice: Subject to any disclaimer, the term of this patent is extended or adjusted under 35 U.S.C. 154(b) by 0 days.

(21) Appl. No.: 16/886,185

(22) Filed: May 28, 2020

(65) Prior Publication Data

US 2021/0375097 A1 Dec. 2, 2021

(51) Int. Cl.
*G07F 17/34* (2006.01)
*G07F 17/32* (2006.01)

(52) U.S. Cl.
CPC ..... *G07F 17/3267* (2013.01); *G07F 17/3213* (2013.01); *G07F 17/34* (2013.01)

(58) Field of Classification Search
CPC ... G07F 17/3267; G07F 17/3213; G07F 17/34
USPC ..... 463/20
See application file for complete search history.

(56) References Cited

U.S. PATENT DOCUMENTS

| | | | | |
|---|---|---|---|---|
| 4,492,378 | A | 1/1985 | Williams | |
| 5,184,821 | A | 2/1993 | Korenek | |
| 5,188,363 | A | 2/1993 | Marnell, II | |
| 5,839,955 | A | 11/1998 | Mangano | |
| 6,342,007 | B1 | 1/2002 | Wood | |
| 7,399,226 | B2 | 7/2008 | Mishra | |
| 7,618,316 | B2 | 11/2009 | Cote et al. | |
| 8,246,437 | B2 | 8/2012 | Haag | |
| 8,408,990 | B2 | 4/2013 | De Waal et al. | |
| 10,332,357 | B2 | 6/2019 | Berman | |
| 10,810,827 | B2 * | 10/2020 | Grace | G07F 17/3267 |
| 2002/0065126 | A1 | 5/2002 | Miller | |
| 2004/0162133 | A1 * | 8/2004 | Jackson | G07F 17/34 463/20 |
| 2004/0204228 | A1 | 10/2004 | Walker | |
| 2005/0288088 | A1 | 12/2005 | Englman | |

(Continued)

FOREIGN PATENT DOCUMENTS

| | | | |
|---|---|---|---|
| KR | 100779759 | B1 | 11/2007 |
| KR | 20070109538 | A | 11/2007 |

OTHER PUBLICATIONS

IGT Wheel Poker Deluxe, (May 2019), 1 page.

(Continued)

*Primary Examiner* — Jay Trent Liddle
*Assistant Examiner* — Ryan Hsu
(74) *Attorney, Agent, or Firm* — Blank Rome LLP

(57) ABSTRACT

A slot game integrates a wheel positioned between one or more preceding reels and one or more subsequent reels. The game controller may dynamically populate the wheel with symbols from the outcome of the one or more preceding reels. The controller determines a symbol outcome for the wheel and performs pay evaluation based on applying the symbol outcome as positioned between the one or more preceding reel outcomes and the one or more subsequent reel outcomes. The game controller may perform cross-symbol mapping to map the symbol outcome to a subsequent reel.

20 Claims, 17 Drawing Sheets

(56) References Cited

U.S. PATENT DOCUMENTS

2006/0046821 A1* 3/2006 Kaminkow ..... G07F 17/326 463/16
2007/0057452 A1 3/2007 Dargue
2009/0111577 A1* 4/2009 Mead ..... G07F 17/3211 463/31
2010/0016062 A1 1/2010 Baerlocher
2010/0029381 A1* 2/2010 Vancura ..... G07F 17/3244 463/30
2011/0059789 A1 3/2011 Luciano
2012/0122545 A1 5/2012 Watkins
2014/0094280 A1* 4/2014 Berman ..... G07F 17/3225 463/25
2015/0087378 A1 3/2015 Louie
2015/0087403 A1 3/2015 Castro
2015/0302700 A1* 10/2015 Zielinski ..... G07F 17/3258 463/20
2018/0025590 A1 1/2018 Ballone

OTHER PUBLICATIONS

David Currie, "Wheel Poker Deluxe—South Point." YouTube online video, Retrieved from the Internet: <https://www.youtube.com/watch?v=KXS7P06cvWI>, (last accessed May 1, 2019), 2 pages.
Notice of Allowance dated Mar. 23, 2020, for U.S. Appl. No. 15/824,079 (pp. 1-5).
Office Action dated Oct. 29, 2020 for U.S. Appl. No. 16/905,509 (pp. 1-17).
Notice of Allowance dated Mar. 31, 2021 for U.S. Appl. No. 16/905,509 (pp. 1-8).

* cited by examiner

INTEGRATING A WHEEL BETWEEN REELS OF A SLOT GAME

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In some cases, a player may qualify for a special mode of the base game, a secondary game, or a bonus round of the base game by attaining a certain winning combination or triggering event in, or related to, the base game, or after the player is randomly awarded the special mode, secondary game, or bonus round. In the special mode, secondary game, or bonus round, the player is given an opportunity to win extra game credits, game tokens or other forms of payout. In the case of "game credits" that are awarded during play, the game credits are typically added to a credit meter total on the EGM and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or win paths) through the matrix indicate the outcome of the game. The display typically highlights winning combinations/outcomes for identification by the player. Matching combinations and their corresponding awards are usually shown in a "pay-table" which is available to the player for reference. Often, the player may vary his/her wager to include differing numbers of win paths and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player over the course of many plays or instances of the game, which is generally referred to as return to player (RTP). The RTP and randomness of the RNG ensure the fairness of the games and are highly regulated. Upon initiation of play, the RNG randomly determines a game outcome and symbols are then selected which correspond to that outcome. Notably, some games may include an element of skill on the part of the player and are therefore not entirely random.

SUMMARY

Embodiments provide a gaming device, a method, and a gaming system with an integrated wheel positioned between one or more preceding reel outcomes and one or more subsequent reel outcomes. In various embodiments, the wheel can be populated based on the display symbols of an outcome presented on the preceding reels, and a selection from those populated symbols on the wheel can be made to determine a symbol outcome of the wheel. In some embodiments the symbol outcome can be cross-symbol mapped to a subsequent reel.

An embodiment provides a system including a game controller including one or more processors; the game controller executes instructions which cause the game controller to determine a game outcome and perform a pay evaluation of the game outcome; determining the game outcome includes randomly determining, based on a first outcome from a random number generator, a first set of display symbols selected from a full symbol set to populate one or more preceding reel, the first set of display symbols representing one or more preceding reel outcomes; determining the game outcome further includes determining a second set of display symbols to populate slices of a wheel, at least one display symbol of the second set of display symbols being selected from the first set of display symbols; determining the game outcome further includes determining a symbol outcome for the wheel; determining the game outcome further includes determining a third set of display symbols to populate one or more subsequent reels, the third set of display symbols representing one or more subsequent reel outcomes; performing the pay evaluation of the game outcome includes applying the symbol outcome of the wheel positioned between the one or more preceding reel outcomes and the one or more subsequent reel outcomes.

Another embodiment provides a method of integrating a wheel between reels of a slot game comprising determining, by a game controller, a game outcome, performing, by a game controller, a pay evaluation of the game outcome, and controlling, by a game controller, the display system to display the game outcome; determining the game outcome includes determining a first set of display symbols selected from a full symbol set to populate one or more preceding reel, the first set of display symbols representing one or more preceding reel outcomes; determining the game outcome further includes determining a second set of display symbols to populate slices of a wheel, at least one display symbol of the second set of display symbols being selected from the first set of display symbols; determining the game outcome further includes determining a symbol outcome for the wheel; determining the game outcome further includes determining a third set of display symbols to populate one or more subsequent reels, the third set of display symbols representing one or more subsequent reel outcomes; performing the pay evaluation of the game outcome includes applying the symbol outcome of the wheel positioned between the one or more preceding reel outcomes and the one or more subsequent reel outcomes; controlling the display system to display the game outcome includes displaying the wheel positioned between the one or more preceding reels and the one or more subsequent reels; controlling the display system to display the game outcome includes displaying the first set of display symbols at the one or more preceding reels; controlling the display system to display the game outcome includes displaying the second set of display symbols at the wheel; controlling the display system to display the game outcome includes displaying selection of the symbol outcome for the wheel; controlling the display system to display the game outcome includes also includes displaying the third set of display symbols at the one or more subsequent reels.

Another embodiment provides one or more non-transitory media having software stored thereon, the software including instructions for controlling one or more devices to perform a method the method comprising determining, by a game controller, a game outcome, performing, by a game controller, a pay evaluation of the game outcome, and controlling, by a game controller, the display system to display the game outcome; determining the game outcome includes determining a first set of display symbols selected from a full symbol set to populate one or more preceding reel, the first set of display symbols representing one or more preceding reel outcomes; determining the game outcome further includes determining a second set of display symbols to populate slices of a wheel, at least one display symbol of the second set of display symbols being selected from the first set of display symbols; determining the game outcome further includes determining a symbol outcome for the wheel; determining the game outcome further includes determining a third set of display symbols to populate one or more subsequent reels, the third set of display symbols representing one or more subsequent reel outcomes; performing the pay evaluation of the game outcome includes applying the symbol outcome of the wheel positioned between the one or more preceding reel outcomes and the one or more subsequent reel outcomes; controlling the display system to display the game outcome includes displaying the wheel positioned between the one or more preceding reels and the one or more subsequent reels; controlling the display system to display the game outcome includes displaying the first set of display symbols at the one or more preceding reels; controlling the display system to display the game outcome includes displaying the second set of display symbols at the wheel; controlling the display system to display the game outcome includes displaying selection of the symbol outcome for the wheel; controlling the display system to display the game outcome includes also includes displaying the third set of display symbols at the one or more subsequent reels.

DETAILED DESCRIPTION

Figure 1:
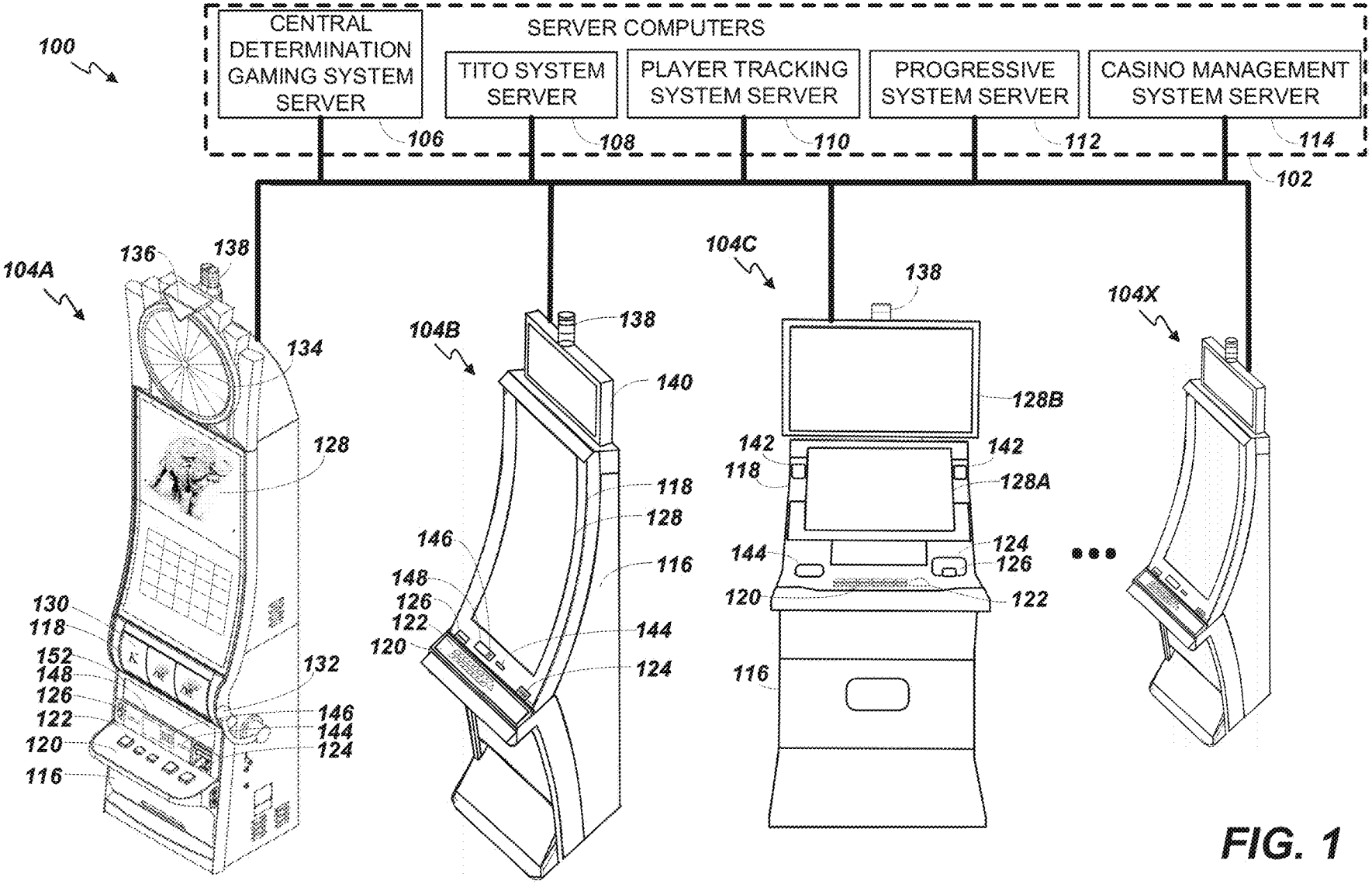
FIG. 1 is an exemplary diagram showing several EGMs networked with various gaming related servers.

The present disclosure is generally directed to utilizing a wheel between one or more preceding reels and one or more subsequent reels for a slot game which can be a base game, a secondary game, and/or a bonus game. In various examples, the wheel may be randomly inserted in a slot game, in place of a reel. For example, a first game instance may present five reels; and in response to a trigger condition, or a random determination, a subsequent game instance may present four reels in combination with a wheel.

Generally, in selected examples, the game includes at least one preceding reel before the wheel, and at least one subsequent reel following the wheel (in a selected direction of orientation, such as left to tight or top to bottom, for example). In some embodiments, radial regions of the wheel ("slices") can be dynamically populated by symbols that land on the preceding reels as part of a game outcome. In such examples, the wheel utilizes a dynamic symbol for each wheel slice where symbol types that land on preceding reels are mapped to each wheel slice (or symbols mapped to the respective wheel slices may be selected from the preceding reel outcomes symbols). As described later herein, in some examples, one or more wheel slices may be populated with symbols additional to those landing on the preceding reels. The dynamic symbols are populated for each game instance, and a lookup table can be used to map symbols from the preceding reels to the specific wheel slices. After dynamically populating the reel with symbols from preceding reels, the game may further determine which wheel slice to land on the accordance with a selected symbol outcome for the wheel. During pay evaluation, the wheel symbol outcome may be applied between the preceding reel outcome symbols and the subsequent reel outcome symbols, such that win paths can extend from the preceding reel(s) to the subsequent reel(s) via the wheel.

In some examples, the game performs cross-symbol mapping of the symbol outcome of the wheel onto a subsequent reel, such that the outcome of one or more subsequent reels at each displayed symbol position is the same as the wheel symbol outcome. The game controller may also perform a cross-symbol check to vary the occurrence of such cross-symbol mapping. Other embodiments could populate the wheel by randomly selecting different predefined wheel layouts, dynamically assigning symbols not limited to the preceding reels, a combination of these, or the like.

The present disclosure provides various technical improvements including new EGM gaming functionality that has not been previously implemented including, providing a wheel between reels in a slot game, and/or changing the position of the wheel within the slot game, and/or symbol mapping to the wheel and/or symbol mapping from the symbol outcome of the wheel to a subsequent reel. These features add variability to the game play while satisfying gaming regulations. As an example, symbol mapping to the wheel and/or to one or more subsequent reels provides a way to achieve a desired game volatility (e.g., increase game volatility) while maintaining a designated level of RTP for a game. Further, in some embodiments, these features may be integrated with the user interface in a way that improves the player experience and/or game understandability. For example, inclusion of a wheel in place of a reel and mapping of symbols can improve a player's understandability on when a game winning outcome occurs. In some embodiments, the user interface may increase player involvement in the game, for example the player may additionally actuate the wheel separately from the initiation of the spin. These and other features are described in greater detail below.

For the purposes of this disclosure, the slot game integrating a wheel between reels may be of any size (e.g., number of reels) or orientation (e.g., vertical or horizontal). For clarity and simplicity in the present description, the term "reel" is primarily discussed with regard to a vertical reel representing a column of symbol outcomes. However, the term "reel" could also refer to individual reels located at each symbol position of the game matrix and/or a horizontal reel representing a row of symbol outcomes. Any number of reels and/or number of symbols per reel may be used with an integrated wheel while remaining within the scope of the present application. For the purposes of this disclosure "game outcome" and "game instance outcome" are used interchangeably to refer to an outcome of a single play cycle (e.g., a single "spin") of a base game, a secondary game, and/or a bonus game, whether or not there are subsequent plays or subsequent game instances. Although the term "game outcome" and "game instance outcome" primarily refer to a slot game throughout this disclosure, the term is not limited to this game type and could be applicable to other game types, such as keno, video poker, video blackjack, pachinko, etc.

FIG. 1 illustrates several different models of EGMs which may be networked to various gaming related servers. Shown is a system 100 in a gaming environment including one or more server computers 102 (e.g., slot servers of a casino) that are in communication, via a communications network, with one or more gaming devices 104A-104X (EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console. Gaming devices 104A-104X utilize specialized software and/or hardware to form non-generic, particular machines or apparatuses that comply with regulatory requirements regarding devices used for wagering or games of chance that provide monetary awards.

Communication between the gaming devices 104A-104X and the server computers 102, and among the gaming devices 104A-104X, may be direct or indirect using one or more communication protocols. As an example, gaming devices 104A-104X and the server computers 102 can communicate over one or more communication networks, such as over the Internet through a website maintained by a computer on a remote server or over an online data network including commercial online service providers, Internet service providers, private networks (e.g., local area networks and enterprise networks), and the like (e.g., wide area networks). The communication networks could allow gaming devices 104A-104X to communicate with one another and/or the server computers 102 using a variety of communication-based technologies, such as radio frequency (RF) (e.g., wireless fidelity (WiFi®) and Bluetooth®), cable TV, satellite links and the like.

In some implementation, server computers 102 may not be necessary and/or preferred. For example, in one or more implementations, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door which provides access to the interior of the cabinet. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The mechanical reels 130 are independently spun and stopped to show a set of symbols within the gaming display area 118 which may be used to determine an outcome to the game.

In many configurations, the gaming device 104A may have a main display 128 (e.g., video display monitor) mounted to, or above, the gaming display area 118. The main display 128 can be a high-resolution liquid crystal display (LCD), plasma, light emitting diode (LED), or organic light emitting diode (OLED) panel which may be flat or curved as shown, a cathode ray tube, or other conventional electronically controlled video monitor.

In some implementations, the bill validator 124 may also function as a "ticket-in" reader that allows the player to use a casino issued credit ticket to load credits onto the gaming device 104A (e.g., in a cashless ticket ("TITO") system). In such cashless implementations, the gaming device 104A may also include a "ticket-out" printer 126 for outputting a credit ticket when a "cash out" button is pressed. Cashless TITO systems are used to generate and track unique barcodes or other indicators printed on tickets to allow players to avoid the use of bills and coins by loading credits using a ticket reader and cashing out credits using a ticket-out printer 126 on the gaming device 104A. The gaming device 104A can have hardware meters for purposes including ensuring regulatory compliance and monitoring the player credit balance. In addition, there can be additional meters that record the total amount of money wagered on the gaming device, total amount of money deposited, total amount of money withdrawn, total amount of winnings on gaming device 104A.

In some implementations, a player tracking card reader 144, a transceiver for wireless communication with a mobile device (e.g., a player's smartphone), a keypad 146, and/or an illuminated display 148 for reading, receiving, entering, and/or displaying player tracking information is provided in gaming device 104A. In such implementations, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), win paths (e.g. paylines), pay tables, and/or various game related graphics. In some implementations, the information panel(s) 152 may be implemented as an additional video display.

Gaming devices 104A have traditionally also included a handle 132 typically mounted to the side of main cabinet 116 which may be used to initiate game play.

Figure 2A:
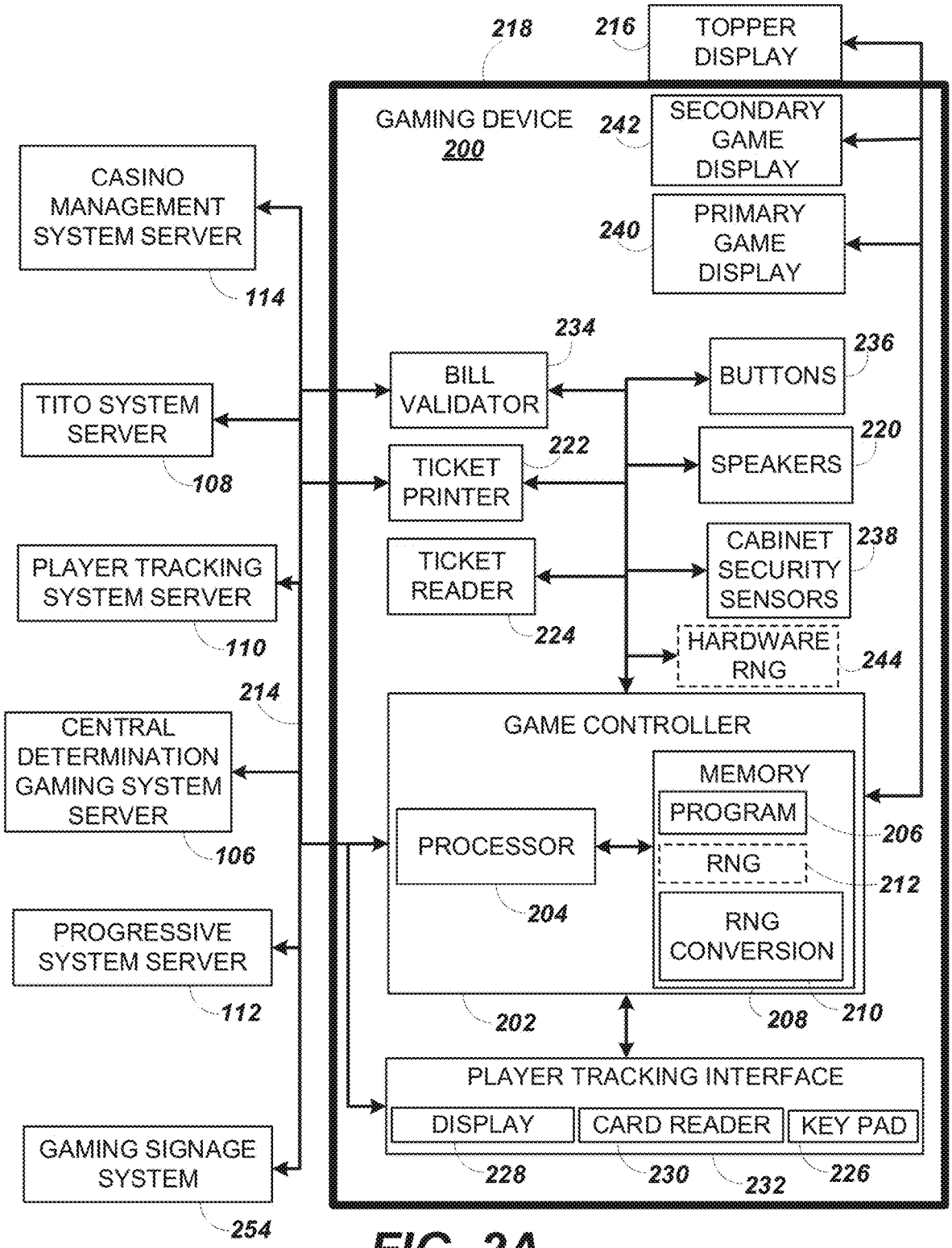
FIG. 2A is a block diagram showing various functional elements of an exemplary EGM.

Many or all the above described components can be controlled by circuitry (e.g., a game controller) housed inside the main cabinet 116 of the gaming device 104A, the details of which are shown in FIG. 2A.

An alternative example gaming device 104B illustrated in FIG. 1 is the Arc™ model gaming device manufactured by Aristocrat® Technologies, Inc. Note that where possible, reference numerals identifying similar features of the gaming device 104A implementation are also identified in the gaming device 104B implementation using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some implementations, the optional topper screen 140 may also or alternatively be used to display progressive jackpot prizes available to a player during play of gaming device 104B.

Example gaming device 104B includes a main cabinet 116 including a main door which opens to provide access to the interior of the gaming device 104B. The main or service door is typically used by service personnel to refill the ticket-out printer 126 and collect bills and tickets inserted into the bill validator 124. The main or service door may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the main display 128A may have a curvature radius from top to bottom, or alternatively from side to side. In some implementations, main display 128A is a flat panel display. Main display 128A is typically used for primary game play while secondary display 128B is typically used for bonus game play, to show game features or attraction activities while the game is not in play or any other information or media desired by the game designer or operator. In some implementations, example gaming device 104C may also include speakers 142 to output various audio such as game sound, background music, etc.

Many different types of games, including mechanical slot games, video slot games, video poker, video blackjack, video pachinko, keno, bingo, and lottery, may be provided with or implemented within the depicted gaming devices 104A-104C and other similar gaming devices. Each gaining device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2A is a block diagram depicting exemplary internal electronic components of a gaming device 200 connected to various external systems. All or parts of the gaming device 200 shown could be used to implement any one of the example gaming devices 104A-X depicted in FIG. 1. As shown in FIG. 2A, gaming device 200 includes a topper display 216 or another form of a top box (e.g., a topper wheel, a topper screen, etc.) that sits above cabinet 218. Cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. Player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. FIG. 2 also depicts utilizing a ticket printer 222 to print tickets for a TITO system server 108. Gaming device 200 may further include a bill validator 234, player-input buttons 236 for player input, cabinet security sensors 238 to detect unauthorized opening of the cabinet 218, a primary game display 240, and a secondary game display 242, each coupled to and operable under the control of game controller 202.

The games available for play on the gaming device 200 are controlled by a game controller 202 that includes one or more processors 204. Processor 204 represents a general-purpose processor, a specialized processor intended to perform certain functional tasks, or a combination thereof. As an example, processor 204 can be a central processing unit (CPU) that has one or more multi-core processing units and memory mediums (e.g., cache memory) that function as buffers and/or temporary storage for data. Alternatively, processor 204 can be a specialized processor, such as an application specific integrated circuit (ASIC), graphics processing unit (GPU), field-programmable gate array (FPGA), digital signal processor (DSP), or another type of hardware accelerator. In another example, processor 204 is a system on chip (SoC) that combines and integrates one or more general-purpose processors and/or one or more specialized processors. Although FIG. 2A illustrates that game controller 202 includes a single processor 204, game controller 202 is not limited to this representation and instead can include multiple processors 204 (e.g., two or more processors).

FIG. 2A illustrates that processor 204 is operatively coupled to memory 208. Memory 208 is defined herein as including volatile and nonvolatile memory and other types of non-transitory data storage components. Volatile memory is memory that do not retain data values upon loss of power. Nonvolatile memory is memory that do retain data upon a loss of power. Examples of memory 208 include random access memory (RAM), read-only memory (ROM), hard disk drives, solid-state drives, universal serial bus (USB) flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, examples of RAM include static random access memory (SRAM), dynamic random access memory (DRAM), magnetic random access memory (MRAM), and other such devices. Examples of ROM include a programmable read-only memory (PROM), an erasable programmable read-only memory (EPROM), an electrically erasable programmable read-only memory (EEPROM), or other like memory device. Even though FIG. 2A illustrates that game controller 202 includes a single memory 208, game controller 202 could include multiple memories 208 for storing program instructions and/or data.

Memory 208 can store one or more game programs 206 that provide program instructions and/or data for carrying out various implementations (e.g., game mechanics) described herein. Stated another way, game program 206 represents an executable program stored in any portion or component of memory 208. In one or more implementations, game program 206 is embodied in the form of source code that includes human-readable statements written in a programming language or machine code that contains numerical instructions recognizable by a suitable execution system, such as a processor 204 in a game controller or other system. Examples of executable programs include: (1) a compiled program that can be translated into machine code in a format that can be loaded into a random access portion of memory 208 and run by processor 204; (2) source code that may be expressed in proper format such as object code that is capable of being loaded into a random access portion of memory 208 and executed by processor 204; and (3) source code that may be interpreted by another executable program to generate instructions in a random access portion of memory 208 to be executed by processor 204.

Alternatively, game programs 206 can be set up to generate one or more game instances based on instructions and/or data that gaming device 200 exchanges with one or more remote gaming devices, such as a central determination gaming system server 106 (not shown in FIG. 2A but shown in FIG. 1). For purpose of this disclosure, the term "game instance" refers to a play or a round of a game that gaming device 200 presents (e.g., via a user interface (UI)) to a player. The game instance is communicated to gaming device 200 via the network 214 and then displayed on gaming device 200. For example, gaming device 200 may execute game program 206 as video streaming software that allows the game to be displayed on gaming device 200. When a game is stored on gaming device 200, it may be loaded from memory 208 (e.g., from a read only memory (ROM)) or from the central determination gaming system server 106 to memory 208.

Gaming devices, such as gaming device 200, are highly regulated to ensure fairness and, in many cases, gaming device 200 is operable to award monetary awards (e.g., typically dispensed in the form of a redeemable voucher). Therefore, to satisfy security and regulatory requirements in a gaming environment, hardware and software architectures are implemented in gaming devices 200 that differ significantly from those of general-purpose computers. Adapting general purpose computers to function as gaming devices 200 is not simple or straightforward because of (1) the regulatory requirements for gaming devices 200, (2) the harsh environment in which gaming devices 200 operate, (3) security requirements, (4) fault tolerance requirements, and (5) the requirement for additional special purpose componentry enabling functionality of an EGM. These differences require substantial engineering effort with respect to game design implementation, game mechanics, hardware components, and software.

One regulatory requirement for games running on gaming device 200 generally involves complying with a certain level of randomness. Typically, gaming jurisdictions mandate that gaming devices 200 satisfy a minimum level of randomness without specifying how a gaming device 200 should achieve this level of randomness. To comply, FIG. 2A illustrates that gaming device 200 could include an RNG 212 that utilizes hardware and/or software to generate RNG outcomes that lack any pattern. The RNG operations are often specialized and non-generic in order to comply with regulatory and gaming requirements. For example, in a slot game, game program 206 can initiate multiple RNG calls to RNG 212 to generate RNG outcomes, where each RNG call and RNG outcome corresponds to an outcome for a reel. In another example, gaming device 200 can be a Class II gaming device where RNG 212 generates RNG outcomes for creating Bingo cards. In one or more implementations, RNG 212 could be one of a set of RNGs operating on gaming device 200. More generally, an output of the RNG 212 can be the basis on which game outcomes are determined by the game controller 202. Game developers could vary the degree of true randomness for each RNG (e.g., pseudorandom) and utilize specific RNGs depending on game requirements. The output of the RNG 212 can include a random number or pseudorandom number (either is generally referred to as a "random number").

In FIG. 2A, RNG 212 and hardware RNG 244 are shown in dashed lines to illustrate that RNG 212, hardware RNG 244, or both can be included in gaming device 200. In one implementation, instead of including RNG 212, gaming device 200 could include a hardware RNG 244 that generates RNG outcomes. Analogous to RNG 212, hardware RNG 244 performs specialized and non-generic operations in order to comply with regulatory and gaming requirements. For example, because of regulation requirements, hardware RNG 244 could be a random number generator that securely produces random numbers for cryptography use. The gaming device 200 then uses the secure random numbers to generate game outcomes for one or more game features. In another implementation, the gaming device 200 could include both hardware RNG 244 and RNG 212. RNG 212 may utilize the RNG outcomes from hardware RNG 244 as one of many sources of entropy for generating secure random numbers for the game features.

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%). A game can use one or more lookup tables as part of a technical solution that satisfies regulatory requirements for randomness and RTP. In particular, a lookup table can integrate game features (e.g., trigger events for special modes or bonus games; newly introduced game elements such as extra reels, new symbols, or new cards; stop positions for dynamic game elements such as spinning reels, spinning wheels, or shifting reels; or card selections from a deck) with random numbers generated by one or more RNGs, so as to achieve a given level of volatility for a target level of RTP. (In general, volatility refers to the frequency or probability of an event such as a special mode, payout, etc. For example, for a target level of RTP, a higher-volatility game may have a lower payout most of the time with an occasional bonus having a very high payout, while a lower-volatility game has a steadier payout with more frequent bonuses of smaller amounts.) Configuring a lookup table can involve engineering decisions with respect to how RNG outcomes are mapped to game outcomes for a given game feature, while still satisfying regulatory requirements for RTP. Configuring a lookup table can also involve engineering decisions about whether different game features are combined in a given entry of the lookup table or split between different entries (for the respective game features), while still satisfying regulatory requirements for RTP and allowing for varying levels of game volatility. A weighted table is one type of lookup table and the two terms can be used interchangeably throughout the present disclosure.

The lookup tables, in the form of weighted tables, can have one of many possible configurations. In general, a weighted table can be implemented as any data structure that assigns probabilities to different options, in order for one of the different options to be selected using a random number. Different options are represented in different entries of a weighted table. For example, there may be multiple possible values within each tier of the weighted table, and the multiple possible values may be unequally weighted. The probabilities for different options can be reflected in threshold values (e.g., for a random number RND, generated by an RNG, in the range of 1<RND<=40 for option 1, 40<RND<=70 for option 2, 70<RND<=90 for option 3, and 90<RND<=100 for option 4, given four options and a random number RND where 0<RND<=100). The threshold values can represent percentages or, more generally, subranges within the range for a random number. In some example implementations, the threshold values for a weighted table are represented as count values for the respective entries of the weighted table. For example, the following table shows count values for the four options described above:

TABLE 1

Example Weighted Table

| count value | entry |
|---|---|
| 40 | <value a1, value a2, . . .> |
| 30 | <value b1, value b2, . . .> |
| 20 | <value c1, value c2, . . .> |
| 10 | <value d1, value d2, . . .> |

The sum total of the count values indicates the range of the options. Control logic can use a random number, generated between 1 and the sum total of the count values, to select one of the entries in the weighted table by comparing the random number to successive running totals. In the example shown in Table 1, if the random number is 40 or less, the first entry is selected. Otherwise, if the random number is between 41 and 70, the second entry is selected. Otherwise, if the random number is between 71 and 90, the third entry is selected. Otherwise, the last entry is selected.

The threshold values for a weighted table can be fixed and predetermined. Or, the threshold values for a weighted table can vary dynamically (e.g., depending on bet level). Or, a weighted table can be dynamically selected (e.g., depending on bet level) from among multiple available weighted tables. Different parameters or choices during game play can use different weighted tables. Or, different combinations of parameters or choices can be combined in entries of a given weighted table.

FIG. 2A illustrates that gaming device 200 includes an RNG conversion engine 210 that translates the RNG outcome from RNG 212 to a game outcome presented to a player. To meet a designated RTP, a game developer can set up the RNG conversion engine 210 to utilize one or more lookup tables to translate the RNG outcome to a symbol element, stop position on a reel strip layout, and/or randomly chosen aspect of a game feature. As an example, the lookup tables can regulate a prize payout amount for each RNG outcome and how often the gaming device 200 pays out the prize payout amounts. The RNG conversion engine 210 could utilize one lookup table to map the RNG outcome to a game outcome displayed to a player and a second lookup table as a pay table for determining the prize payout amount for each game outcome. The mapping between the RNG outcome to the game outcome controls the frequency in hitting certain prize payout amounts.

FIG. 2A also depicts that gaming device 200 is connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

When a player wishes to play the gaming device 200, he/she can insert cash or a ticket voucher through a coin acceptor (not shown) or bill validator 234 to establish a credit balance on the gaming device. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views with one or more UIs, the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Additionally, or alternatively, gaming devices 104A-104X and 200 can include or be coupled to one or more wireless transmitters, receivers, and/or transceivers (not shown in FIGS. 1 and 2A) that communicate (e.g., Bluetooth® or other near-field communication technology) with one or more mobile devices to perform a variety of wireless operations in a casino environment. Examples of wireless operations in a casino environment include detecting the presence of mobile devices, performing credit, points, comps, or other marketing or hard currency transfers, establishing wagering sessions, and/or providing a personalized casino-based experience using a mobile application. In one implementation, to perform these wireless operations, a wireless transmitter or transceiver initiates a secure wireless connection between a gaining device 104A-104X and 200 and a mobile device. After establishing a secure wireless connection between the gaming device 104A-104X and 200 and the mobile device, the wireless transmitter or transceiver does not send and/or receive application data to and/or from the mobile device. Rather, the mobile device communicates with gaming devices 104A-104X and 200 using another wireless connection e.g., WiFi® or cellular network). In another implementation, a wireless transceiver establishes a secure connection to directly communicate with the mobile device. The mobile device and gaming device 104A-104X and 200 sends and receives data utilizing the wireless transceiver instead of utilizing an external network. For example, the mobile device would perform digital wallet transactions by directly communicating with the wireless transceiver. In one or more implementations, a wireless transmitter could broadcast data received by one or more mobile devices without establishing a pairing connection with the mobile devices.

Although FIGS. 1 and 2A illustrate specific implementations of a gaming device (e.g., gaming devices 104A-104X and 200), the disclosure is not limited to those implementations shown in FIGS. 1 and 2. For example, not all gaming devices suitable for implementing implementations of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or tabletops and have displays that face upwards. Gaming devices 104A-104X and 200 may also include other processors that are not separately shown. Using FIG. 2A as an example, gaming device 200 could include display controllers (not shown in FIG. 2A) configured to receive video input signals or instructions to display images on game displays 240 and 242. Alternatively, such display controllers may be integrated into the game controller 202. The use and discussion of FIGS. 1 and 2 are examples to facilitate ease of description and explanation.

Figure 2B:
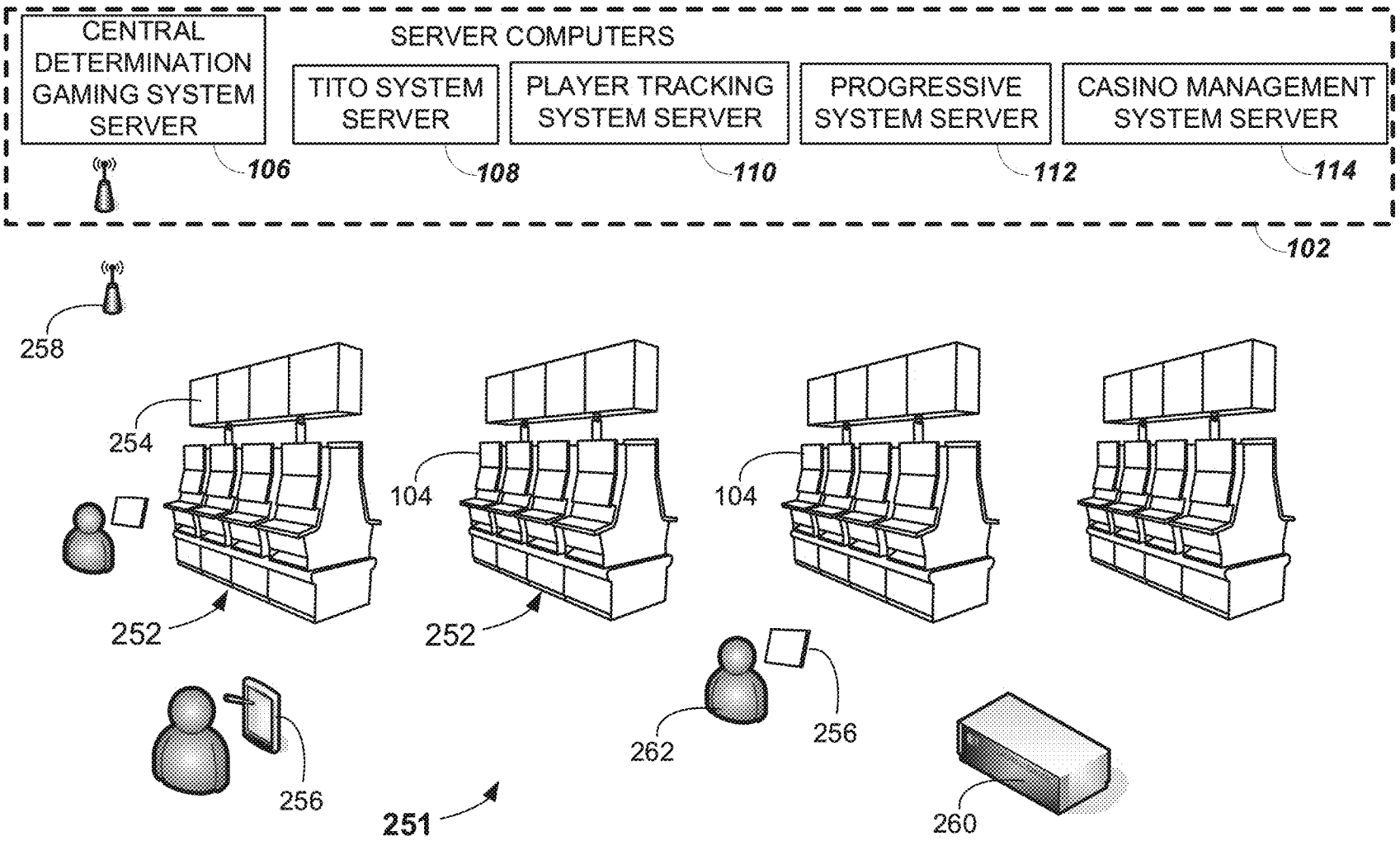
FIG. 2B depicts a casino gaming environment according to one example.

FIG. 2B depicts a casino gaming environment according to one example. In this example, the casino 251 includes banks 252 of EGMs 104. In this example, each bank 252 of EGMs 104 includes a corresponding gaming signage system 254 (also shown in FIG. 2A). According to this implementation, the casino 251 also includes mobile gaming devices 256, which are also configured to present wagering games in this example. The mobile gaming devices 256 may, for example, include tablet devices, cellular phones, smart phones and/or other handheld devices. In this example, the mobile gaming devices 256 are configured for communication with one or more other devices in the casino 251, including but not limited to one or more of the server computers 102, via wireless access points 258.

According to some examples, the mobile gaming devices 256 may be configured for stand-alone determination of game outcomes. However, in some alternative implementations the mobile gaming devices 256 may be configured to receive game outcomes from another device, such as the central determination gaming system server 106, one of the EGMs 104, etc.

Some mobile gaming devices 256 may be configured to accept monetary credits from a credit or debit card, via a wireless interface (e.g., via a wireless payment app), via tickets, via a patron casino account, etc. However, some mobile gaming devices 256 may not be configured to accept monetary credits via a credit or debit card. Some mobile gaming devices 256 may include a ticket reader and/or a ticket printer whereas some mobile gaming devices 256 may not, depending on the particular implementation.

In some implementations, the casino 251 may include one or more kiosks 260 that are configured to facilitate monetary transactions involving the mobile gaming devices 256, which may include cash out and/or cash in transactions. The kiosks 260 may be configured for wired and/or wireless communication with the mobile gaming devices 256. The kiosks 260 may be configured to accept monetary credits from casino patrons 262 and/or to dispense monetary credits to casino patrons 262 via cash, a credit or debit card, via a wireless interface (e.g., via a wireless payment app), via tickets, etc. According to some examples, the kiosks 260 may be configured to accept monetary credits from a casino patron and to provide a corresponding amount of monetary credits to a mobile gaming device 256 for wagering purposes, e.g., via a wireless link such as a near-field communications link. In some such examples, when a casino patron 262 is ready to cash out, the casino patron 262 may select a cash out option provided by a mobile gaming device 256, which may include a real button or a virtual button (e.g., a button provided via a graphical user interface) in some instances. In some such examples, the mobile gaming device 256 may send a "cash out" signal to a kiosk 260 via a wireless link in response to receiving a "cash out" indication from a casino patron. The kiosk 260 may provide monetary credits to the casino patron 262 corresponding to the "cash out" signal, which may be in the form of cash, a credit ticket, a credit transmitted to a financial account corresponding to the casino patron, etc.

In some implementations, a cash-in process and/or a cash-out process may be facilitated by the TITO system server 108. For example, the TITO system server 108 may control, or at least authorize, ticket-in and ticket-out transactions that involve a mobile gaming device 256 and/or a kiosk 260.

Some mobile gaming devices 256 may be configured for receiving and/or transmitting player loyalty information. For example, some mobile gaming devices 256 may be configured for wireless communication with the player tracking system server 110. Some mobile gaming devices 256 may be configured for receiving and/or transmitting player loyalty information via wireless communication with a patron's player loyalty card, a patron's smartphone, etc.

According to some implementations, a mobile gaming device 256 may be configured to provide safeguards that prevent the mobile gaming device 256 from being used by an unauthorized person. For example, some mobile gaming devices 256 may include one or more biometric sensors and may be configured to receive input via the biometric sensor(s) to verify the identity of an authorized patron. Some mobile gaming devices 256 may be configured to function only within a predetermined or configurable area, such as a casino gaming area.

Figure 2C:
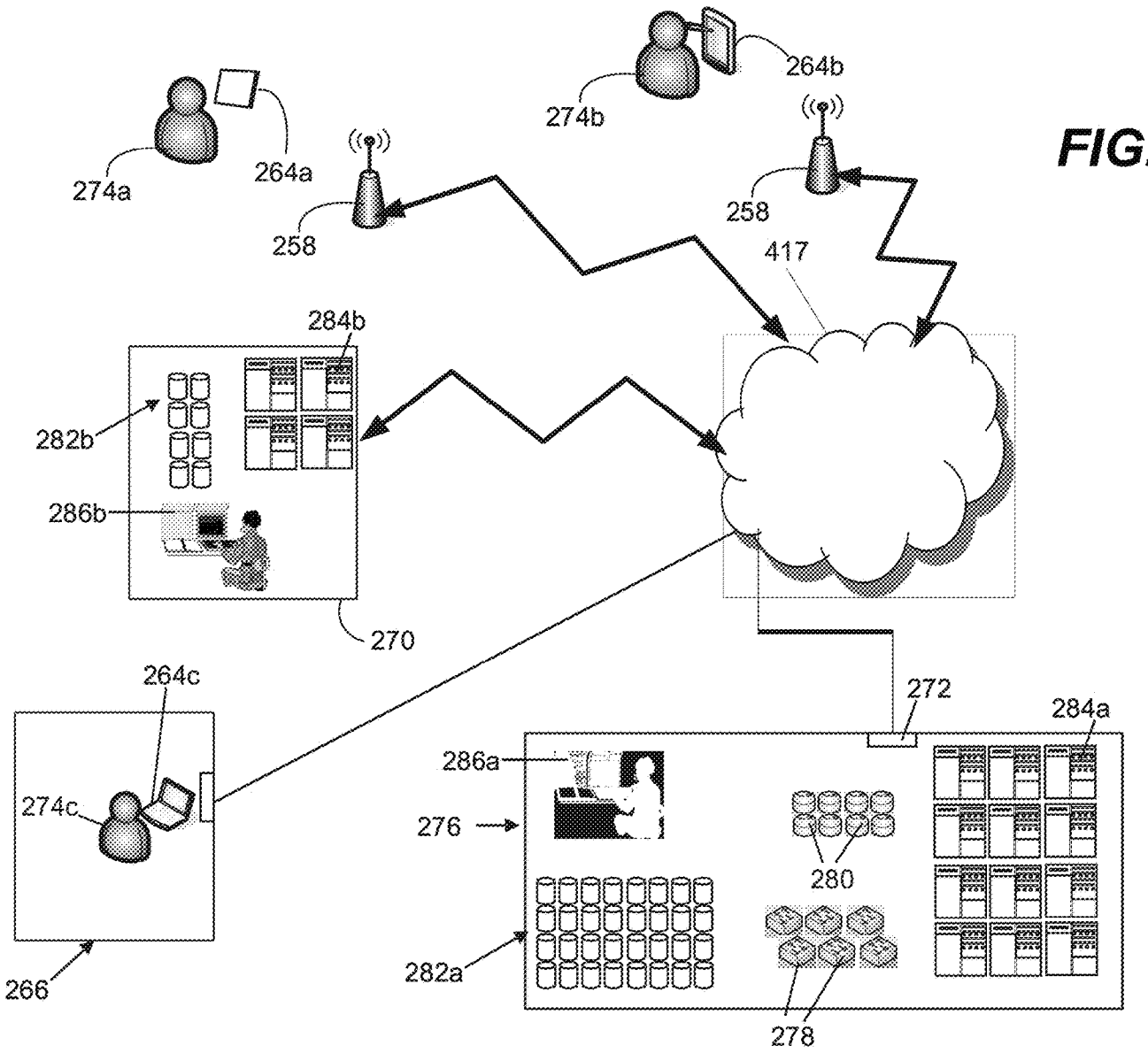
FIG. 2C is a diagram that shows examples of components of a system for providing online gaming according to some aspects of the present disclosure.

FIG. 2C is a diagram that shows examples of components of a system for providing online gaming according to some aspects of the present disclosure. As with other figures presented in this disclosure, the numbers, types and arrangements of gaming devices shown in FIG. 2C are merely shown by way of example. In this example, various gaming devices, including but not limited to end user devices (EUDs) 264*a*, 264*b* and 264*c* are capable of communication via one or more networks 417. The networks 417 may, for example, include one or more cellular telephone networks, the Internet, etc. In this example, the EUDs 264*a* and 264*b* are mobile devices: according to this example the EUD 264*a* is a tablet device and the EUD 264*b* is a smart phone. In this implementation, the EUD 264*c* is a laptop computer that is located within a residence 266 at the time depicted in FIG. 2C. Accordingly, in this example the hardware of EUDs is not specifically configured for online gaming, although each EUD is configured with software for online gaming. For example, each EUD may be configured with a web browser. Other implementations may include other types of EUD, some of which may be specifically configured for online gaming.

In this example, a gaming data center 276 includes various devices that are configured to provide online wagering games via the networks 417. The gaming data center 276 is capable of communication with the networks 417 via the gateway 272. In this example, switches 278 and routers 280 are configured to provide network connectivity for devices of the gaming data center 276, including storage devices 282*a*, servers 284*a* and one or more workstations 570*a*. The servers 284*a* may, for example, be configured to provide access to a library of games for online game play. In some examples, code for executing at least some of the games may initially be stored on one or more of the storage devices 282*a*. The code may be subsequently loaded onto a server 284*a* after selection by a player via an EUD and communication of that selection from the EUD via the networks 417. The server 284*a* onto which code for the selected game has been loaded may provide the game according to selections made by a player and indicated via the player's EUD. In other examples, code for executing at least some of the games may initially be stored on one or more of the servers 284*a*. Although only one gaming data center 276 is shown in FIG. 2C, some implementations may include multiple gaming data centers 276.

In this example, a financial institution data center 270 is also configured for communication via the networks 417. Here, the financial institution data center 270 includes servers 284*b*, storage devices 282*b*, and one or more workstations 286*b*. According to this example, the financial institution data center 270 is configured to maintain financial accounts, such as checking accounts, savings accounts, loan accounts, etc. In some implementations one or more of the authorized users 274*a*-274*c* may maintain at least one financial account with the financial institution that is serviced via the financial institution data center 270.

According to some implementations, the gaming data center 276 may be configured to provide online wagering games in which money may be won or lost. According to some such implementations, one or more of the servers 284*a* may be configured to monitor player credit balances, which may be expressed in game credits, in currency units, or in any other appropriate manner. In some implementations, the server(s) 284*a* may be configured to obtain financial credits from and/or provide financial credits to one or more financial institutions, according to a player's "cash in" selections, wagering game results and a player's "cash out" instructions. According to some such implementations, the server(s) 284*a* may be configured to electronically credit or debit the account of a player that is maintained by a financial institution, e.g., an account that is maintained via the financial institution data center 270. The server(s) 284*a* may, in some examples, be configured to maintain an audit record of such transactions.

In some alternative implementations, the gaming data center 276 may be configured to provide online wagering games for which credits may not be exchanged for cash or the equivalent. In some such examples, players may purchase game credits for online game play, but may not "cash out" for monetary credit after a gaming session. Moreover, although the financial institution data center 270 and the gaming data center 276 include their own servers and storage devices in this example, in some examples the financial institution data center 270 and/or the gaming data center 276 may use offsite "cloud-based" servers and/or storage devices. In some alternative examples, the financial institution data center 270 and/or the gaming data center 276 may rely entirely on cloud-based servers.

One or more types of devices in the gaming data center 276 (or elsewhere) may be capable of executing middleware, e.g., for data management and/or device communication. Authentication information, player tracking information, etc., including but not limited to information obtained by EUDs 264 and/or other information regarding authorized users of EUDs 264 (including but not limited to the authorized users 274*a*-274*c*), may be stored on storage devices 282 and/or servers 284. Other game-related information and/or software, such as information and/or software relating to leaderboards, players currently playing a game, game themes, game-related promotions, game competitions, etc., also may be stored on storage devices 282 and/or servers 284. In some implementations, some such game-related software may be available as "apps" and may be downloadable (e.g., from the gaming data center 276) by authorized users.

In some examples, authorized users and/or entities (such as representatives of gaming regulatory authorities) may obtain gaming-related information via the gaming data center 276. One or more other devices (such EUDs 264 or devices of the gaming data center 276) may act as intermediaries for such data feeds. Such devices may, for example, be capable of applying data filtering algorithms, executing data summary and/or analysis software, etc. In some implementations, data filtering, summary and/or analysis software may be available as "apps" and downloadable by authorized users.

Figure 3:
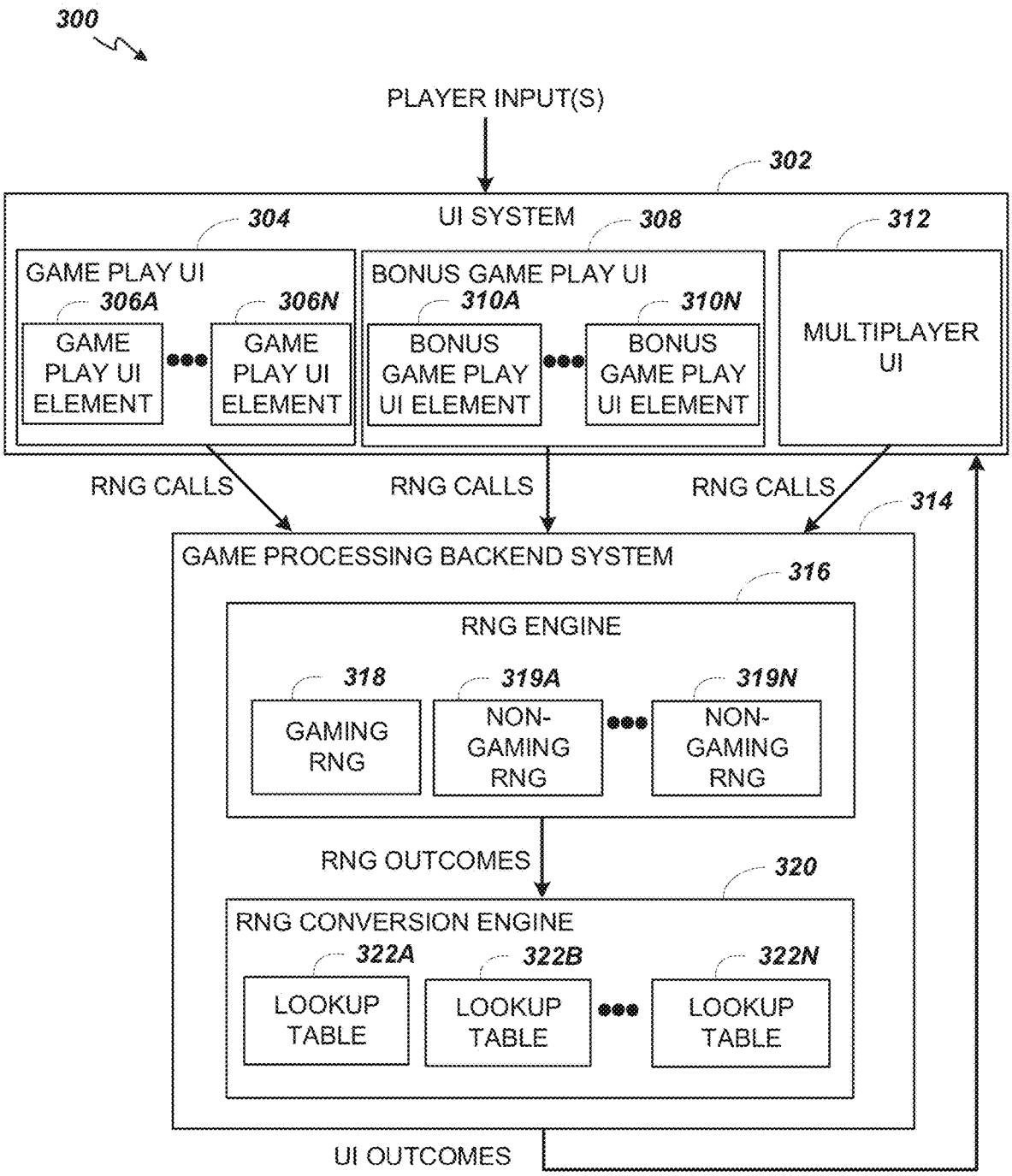
FIG. 3 illustrates, in block diagram form, an implementation of a game processing architecture algorithm that implements a game processing pipeline for the play of a game in accordance with various implementations described herein.

FIG. 3 illustrates, in block diagram form, an implementation of a game processing architecture 300 that implements a game processing pipeline for the play of a game in accordance with various implementations described herein. As shown in FIG. 3, the gaming processing pipeline starts with having a UI system 302 receive one or more player inputs for the game instance. Based on the player input(s), the UI system 302 generates and sends one or more RNG calls to a game processing backend system 314. Game processing backend system 314 then processes the RNG calls with RNG engine 316 to generate one or more RNG outcomes. The RNG outcomes are then sent to the RNG conversion engine 320 to generate one or more game outcomes for the UI system 302 to display to a player. The game processing architecture 300 can implement the game processing pipeline using a gaming device, such as gaming devices 104A-104X and 200 shown in FIGS. 1 and 2, respectively. Alternatively, portions of the gaming processing architecture 300 can implement the game processing pipeline using a gaming device and one or more remote gaming devices, such as central determination gaming system server 106 shown in FIG. 1.

The UI system 302 includes one or more UIs that a player can interact with. The UI system 302 could include one or more game play UIs 304, one or more bonus game play UIs 308, and one or more multiplayer UIs 312, where each UI type includes one or more mechanical His and/or graphical UIs (GUIs). In other words, game play UI 304, bonus game play UI 308, and the multiplayer UI 312 may utilize a variety of UI elements, such as mechanical UI elements (e.g., physical "spin" button or mechanical reels) and/or GUI elements (e.g., virtual reels shown on a video display or a virtual button deck) to receive player inputs and/or present game play to a player. Using FIG. 3 as an example, the different UI elements are shown as game play UI elements 306A-306N and bonus game play UI elements 310A-310N.

The game play UI 304 represents a UI that a player typically interfaces with for a base game. During a game instance of a base game, the game play UI elements 306A-306N (e.g., GUI elements depicting one or more virtual reels) are shown and/or made available to a user. In a subsequent game instance, the UI system 302 could transition out of the base game to one or more bonus games. The bonus game play UI 308 represents a UI that utilizes bonus game play UI elements 310A-310N for a player to interact with and/or view during a bonus game. In one or more implementations, at least some of the game play UI element 306A-306N are similar to the bonus game play UI elements 310A-310N. In other implementations, the game play UI element 306A-306N can differ from the bonus game play UI elements 310A-310N.

FIG. 3 also illustrates that UI system 302 could include a multiplayer UI 312 purposed for game play that differs or is separate from the typical base game. For example, multiplayer UI 312 could be set up to receive player inputs and/or presents game play information relating to a tournament mode. When a gaming device transitions from a primary game mode that presents the base game to a tournament mode, a single gaming device is linked and synchronized to other gaming devices to generate a tournament outcome. For example, multiple RNG engines 316 corresponding to each gaming device could be collectively linked to determine a tournament outcome. To enhance a player's gaming experience, tournament mode can modify and synchronize sound, music, reel spin speed, and/or other operations of the gaming devices according to the tournament game play. After tournament game play ends, operators can switch back the gaming device from tournament mode to a primary game mode to present the base game. Although FIG. 3 does not explicitly depict that multi player UI 312 includes UI elements, multiplayer UI 312 could also include one or more multiplayer UI elements.

Based on the player inputs, the UI system 302 could generate RNG calls to a game processing backend system 314. As an example, the UI system 302 could use one or more application programming interfaces (APIs) to generate the RNG calls. To process the RNG calls, the RNG engine 316 could utilize gaming RNG 318 and/or non-gaming RNGs 319A-319N. Gaming RNG 318 could corresponds to RNG 212 or hardware RNG 244 shown in FIG. 2A. As previously discussed with reference to FIG. 2A, gaming RNG 318 often performs specialized and non-generic operations that comply with regulatory and/or game requirements. For example, because of regulation requirements, gaming RNG 318 could correspond to RNG 212 by being a cryptographic RNG or pseudorandom number generator (PRNG) (e.g., Fortuna PRNG) that securely produces random numbers for one or more game features. To securely generate random numbers, gaming RNG 318 could collect random data from various sources of entropy, such as from an operating system (OS) and/or a hardware RNG (e.g., hardware RNG 244 shown in FIG. 2A). Alternatively, non-gaming RNGs 319A-319N may not be cryptographically secure and/or be computationally less expensive. Non-gaming RNGs 319A-319N can, thus, be used to generate outcomes for non-gaming purposes. As an example, non-gaming RNGs 319A-319N can generate random numbers for generating random messages that appear on the gaming device.

The RNG conversion engine 320 processes each RNG outcome from RNG engine 316 and converts the RNG outcome to a UI outcome that is feedback to the UI system 302. With reference to FIG. 2A, RNG conversion engine 320 corresponds to RNG conversion engine 210 used for game play. As previously described, RNG conversion engine 320 translates the RNG outcome from the RNG 212 to a game outcome presented to a player. RNG conversion engine 320 utilizes one or more lookup tables 322A-322N to regulate a prize payout amount for each RNG outcome and how often the gaming device pays out the derived prize payout amounts. In one example, the RNG conversion engine 320 could utilize one lookup table to map the RNG outcome to a game outcome displayed to a player and a second lookup table as a pay table for determining the prize payout amount for each game outcome. In this example, the mapping between the RNG outcome and the game outcome controls the frequency in hitting certain prize payout amounts. Different lookup tables could be utilized depending on the different game modes, for example, a base game versus a bonus game.

After generating the UI outcome, the game processing backend system 314 sends the UI outcome to the UI system 302. Examples of UI outcomes are symbols to display on a video reel or reel stops for a mechanical reel. In one example, if the UI outcome is for a base game, the UI system 302 updates one or more game play UI elements 306A-306N, such as symbols, for the game play UI 304. In another example, if the UI outcome is for a bonus game, the UI system could update one or more bonus game play UI elements 310A-310N (e.g., symbols) for the bonus game play UI 308. In response to updating the appropriate UI, the player may subsequently provide additional player inputs to initiate a subsequent game instance that progresses through the game processing pipeline.

The example game processing architecture 300 shown in FIG. 3 can be used to process game play instructions and generate outcomes as follows. In some example implementations, the game processing architecture 300 implements a game processing pipeline for a process (e.g., base reel game or bonus reel game) that uses a wheel between reels of a slot game. The UI system 302 (e.g., the game play UT 304 or bonus game play UI 308 of the UI system 302) causes display of a wheel positioned between at least one preceding reel and at least one subsequent reel. For a play, the UI system 302 (e.g., the game play UI 304 or bonus game play UI 308) makes one or more RNG calls to the game processing backend system 314. In response, the backend system 314 performs various operations. For example, using a gaming RNG 318, the RNG engine 316 generates one or more random numbers, which are passed to the RNG conversion engine 320. In various embodiments, the RNG conversion engine 320, can use one or more of the random number(s) and one or more of the lookup tables 322A . . . 322N, to determine a position of the wheel, to determine a set of display symbols to populate the preceding reel(s), to determine a set of display symbols to populate slices of the wheel, to determine a symbol outcome of the wheel, and/or to determine a set of display symbols to populate the subsequent reel(s). After determining a game outcome, including determining the preceding reel outcome(s), the symbol outcome of the wheel, and the subsequent reel outcome(s), the backend system 314 performs a pay evaluation or otherwise determines results (e.g., calculating whether any win conditions exist). In general, the backend system 314 determines the pay evaluation of the game outcome based on applying the symbol outcome of the wheel positioned between the preceding reel outcome(s) and the subsequent reel outcome(s). In some embodiments, the backend system 314 performs the pay evaluation by applying the outcome of the wheel as a vertical stack (in an example with vertically oriented reels) of the wheel outcome symbol, such that the symbol outcome of the wheel is repeated for each horizontal row. The backend system 314 returns generated result to the game play UI 304 or bonus game play UI 308 of the UI system 302, which can among other operations control display of the game outcome and results corresponding to the pay evaluation. For example, the game play UI 304 or bonus game play UI 308 in various embodiments may stop the spinning of reels at the display symbols determined for respective reel outcomes, populate the wheel with the display symbols determined for the wheel, stop the spinning wheel at the symbol outcome determined for the wheel, map display symbols to one or more subsequent reels, and/or indicate win paths extending from the preceding reel(s) through the wheel, and to the subsequent reel(s).

In general, the generated results returned by the backend system 314 can include game-related information (such as display symbols for the respective reels, outcomes) as well as animation effects not related to game parameters. Alternatively, the game play UI 304 (or bonus game play UI 308) can make one or more separate RNG calls to the backend system 314 to determine animation effects. In response, the backend system 314 can use the gaming RNG 318 and/or one or more of the non-gaming RNGs 319A . . . 319N to generate random numbers, which the RNG conversion engine 320 uses (with one or more of the lookup tables 322A . . . 322N) to determine animation effects. The game play UI 304 (or bonus game play UI 308) can perform operations consistent with the animation effects, which are returned from the backend system 314.

Figure 4A:
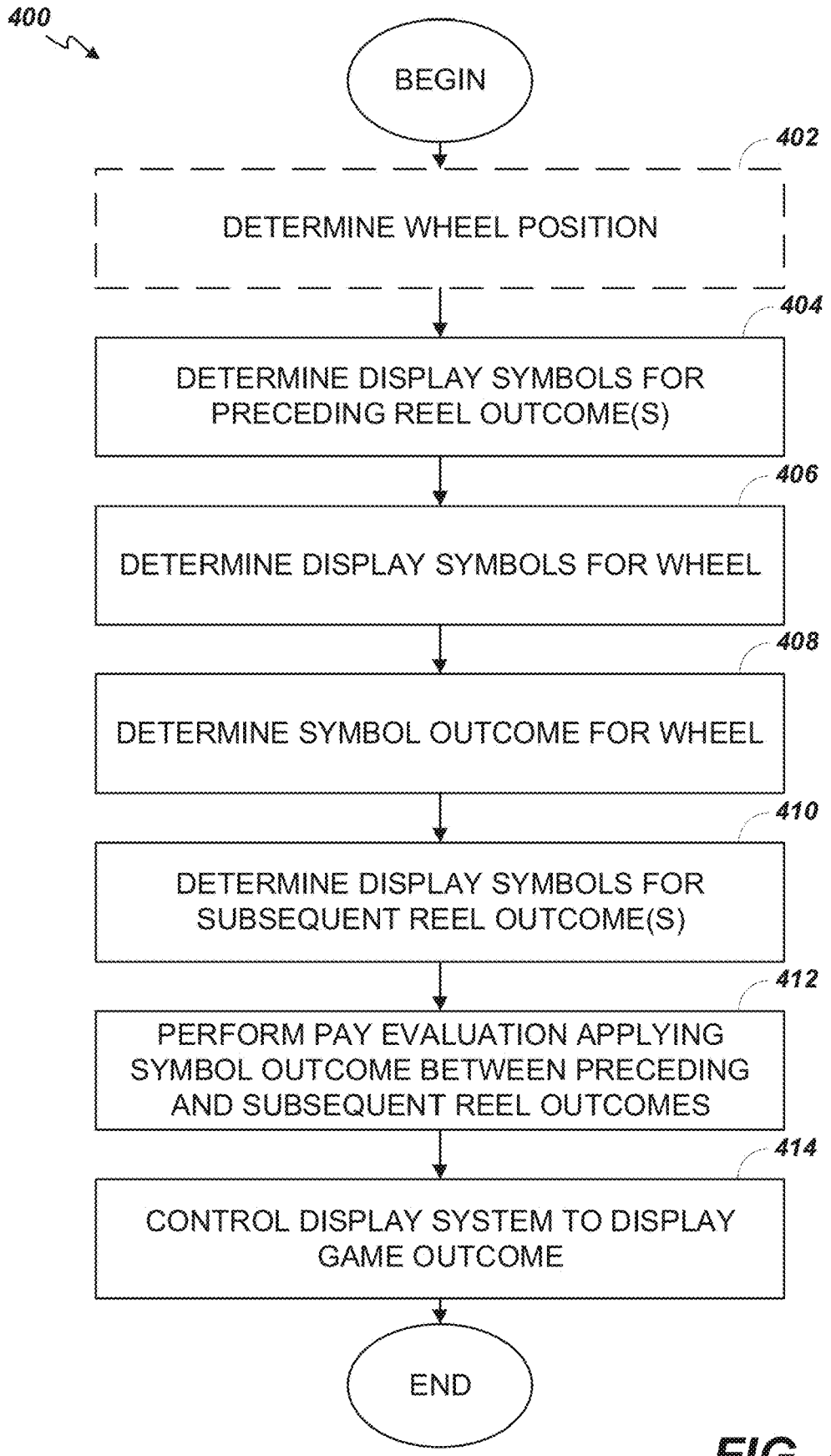
FIGS. 4A-4E are flowcharts illustrating example methods for integrating a wheel between reels of a slot game.

FIG. 4A is a flowchart illustrating an example method 400 for integrating a wheel between reels of a slot game, for example, as may be presented on gaming device 200 of FIG. 2 using the procession architecture 300 of FIG. 3. When presented, the wheel offers a contrasting visual experience for the player. For example, the wheel spins around an axis that extends at an angle, typically perpendicularly to the apparent axis of rotation of the reels. Additionally, while the specific symbols of a reel and the order of those symbols on the reel may not be readily apparent to a player, the symbols of a wheel may be presented in a manner to be always visible to the player. Additionally, the wheel may be configured with a relatively limited number of slices relative to the number of symbols on a reel, and this visibility of the symbols may be of greater interest to a player relative to achieving incremental objectives within the game, thereby improving the player experience.

Prior to the start of method 400, the gaming device 200 may begin game play. For example, the gaming device 200 may establish an associated credit value on a credit meter. For example, a player may insert a physical item having monetary value into a credit input mechanism or device, such as the ticket reader 224 or bill validator 234 of the gaming device 200 or otherwise establish a credit value. In response to the received physical item, the gaming device 200 may increase a credit value based on the monetary value of the physical item. The gaming device 200 may then receive a wager. A player may use input buttons 236 to specify a value of an amount to be wagered with the wager being funded by the credit value of the credit meter. The gaming device 200 may display a message such as "Press SPIN to play" on the primary game display 240 or otherwise. When the player presses a corresponding SPIN button, for example via the player input buttons 236, the gaming device 200 may decrease the player's credit balance by the specified wager and initiate play of a slot-type game. As noted previously, wheel may be integrated in a selected position between multiple reels of a slot game (termed in the following discussion, as noted above, between "preceding" reels and "subsequent" reels), as part of a base game, a secondary game, and/or a bonus game.

At 402, the game controller 202 may optionally determine a wheel position. In other embodiments, the inclusion and placement of a wheel may be at a fixed position for a given game (base, feature, or bonus). In some embodiments, the game controller 202 may change the position of a wheel between one or more game instances based on a predefined or hardcoded sequence, based on a random determination using an RNG and a lookup table operation, based on a combination of these, or the like. In some embodiments, the game controller 202 may determine a position of a wheel with each game instance, In such examples, at a first game instance the game controller 202 determines a first number of preceding reels that will be positioned before the wheel and a first number of subsequent reels that will be positioned after the wheel (as an example, at laterally offset positions, from left to right; though other potential placements are envisioned). At a second game instance, the game controller 202 would determine a second number of preceding reels and a second number of subsequent reels, such that the wheel may have a different position in the second game instance relative to the first game instance. For example, with reference to FIG. 5I, in a first game instance the wheel may take a fourth reel position, such that there are three preceding reels (e.g., reel positions 1-3) and one subsequent reel (e.g., reel position 5), and with reference to FIG. 5J in a second game instance the wheel may take a third reel position, such that there are two preceding reels (e.g., reel positions 1 and 2) and two subsequent reels (e.g., reel positions 4 and 5). In some embodiments, there will be at least one preceding reel and at least one subsequent reel, such that the wheel does not take the first reel position or the last reel position. As an example of such embodiments, in a slot game having five reel positions, (e.g., see illustrated example of FIGS. 5A-5K, and in which the reel positions are laterally arranged (such that the reels are vertically oriented), and occupied from left to right by preceding reel(s) 508, wheel 502, and subsequent reel(s) 510), the wheel will not be positioned in the first reel position or the fifth reel position, both of which will be populated by reels. In some examples the game controller 202 may determine the wheel position based on a predetermined or predefined sequence, e.g. for a slot game having five reel positions the predefined sequence may require that the wheel is positioned at a second reel position for a first game instance, followed by being positioned at a third reel position for a second instance, followed by being positioned at a fourth reel position for a third instance, followed by being positioned at the second reel position for a fourth instance, and so on (since the wheel, in this example, would not be positioned at the first or last reel position). The predefined sequence may include any of the reel positions other than the first reel position and the last reel position, may include certain reel positions with more frequency than others, and/or may define any order of the reel positions (does not have to be in numerical order as provided in the example above). In some embodiments, the wheel position may be static, such that the wheel position does not need to be determined and the method 400 starts at 404. Additionally, as stated previously, in some game instances only reels they be displayed, and the game controller 202 can determine when to insert a wheel in place of the game; in many examples, at least partially in response to an RNG pull, but alternatively, potentially at least partially in response to a triggering event.

Figure 5A:
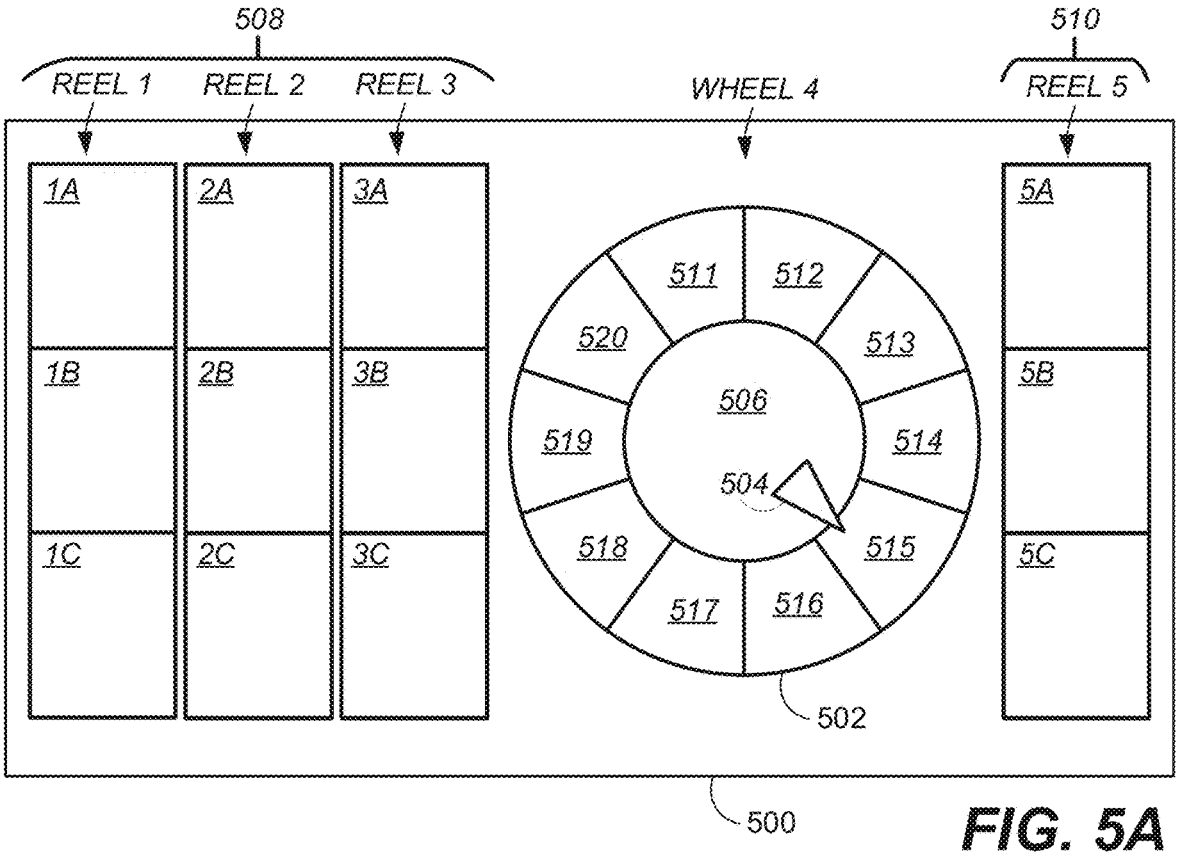
FIGS. 5A-5K are block representations of example display screens integrating a wheel in a slot game having five reel positions.
Figure 5B:
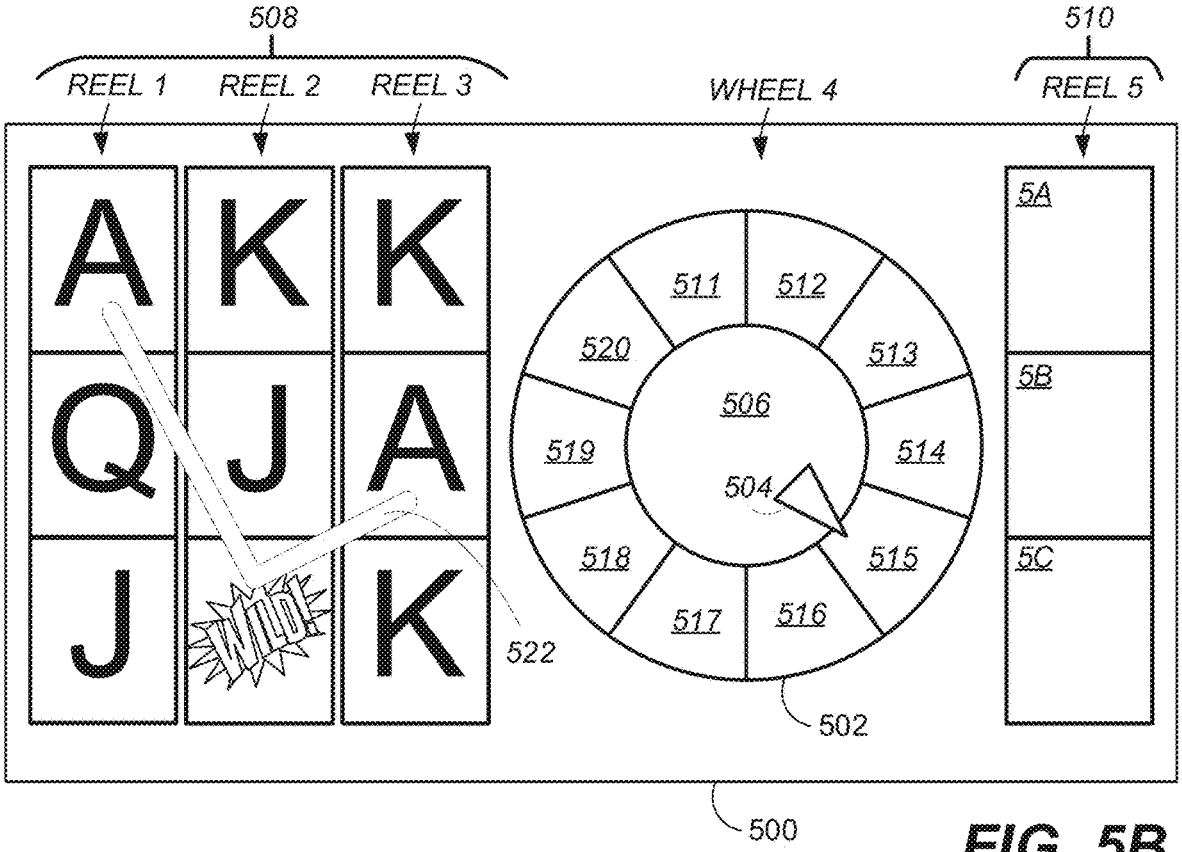

At 404, the game controller 202 determines a first set of display symbols to populate one or more preceding reels in response to a determined preceding reel outcome (e.g., see illustrated example of FIG. 5B). The first set of display symbols may be selected from a full symbol set for the game, such that the first set of display symbols is a subset of the full symbol set, which in many examples will include both configurable and non-configurable symbols. In an example, the configurable symbols may include a common component and at least a variable component. The variable component may be, for example, indicative of a value of a prize that is associated with each of the configurable symbols, for example either an amount, or an indicator of a jackpot (Grand, Major, Mini, for example), and/or may include a "wild" symbol, or a multiplier symbol (2×, 3×, etc.). In some examples, the controller 202 selects the first set of display symbols from a subset of the full symbol set. For each game instance, the game controller 202 will determine the first set of display symbols, such that the one or more preceding reel outcomes may differ in each game instance. In various examples, each reel will have a respective set of display symbols, which may differ from display symbol sets of each other reel, or in some examples may be in common with one or more additional reels. In some examples, the respective set of display symbols for each wheel may be the same, but the weighting of the respective display symbols may be different between one reel and another.

At 406, the game controller 202 determines a second set of display symbols to populate slices of the wheel (e.g., see illustrated example of 5C). The wheel has a plurality of slices that can be populated with display symbols in various manners depending on the embodiment. In some examples, at least one display symbol of the second set of display symbols is selected from the first set of display symbols. That is, one or more slices of the wheel are populated from a displayed outcome of one or more preceding reels (the display symbols that land, for the one or more preceding reels). In some examples, all of the slices of the wheel are populated by symbols from the first set of display symbols. The first set of display symbols may be dynamically mapped to the slices of the wheel, such that prior to initiating the spin and determining the first set of display symbols, the second set of display symbols is unknown. After determining the first set of display symbols from one or more preceding reels, the controller 202 maps the different symbol types to the different wheel slices. In at least one example, the controller 202 can function to space certain or similar display symbols apart from each other (i.e. separated by one or more slices of the wheel). In some examples, a lookup table may be used to determine the symbol that populates on a given wheel slice.

In some examples, the game controller 202 determines the second set of display symbols by selecting the second set of display symbols from the full symbol set. In some examples, the game controller 202 determines the second set of display symbols from a subset of the full symbol set. In at least one example, the game controller 202 may select the second set of display symbols based on a random criterion requiring at least one "wild" symbol, or another specific form of configurable symbol, for example a multiplier symbol (2×, 3×, etc.), and, for example, no more than N of the same symbol.

Figure 7:
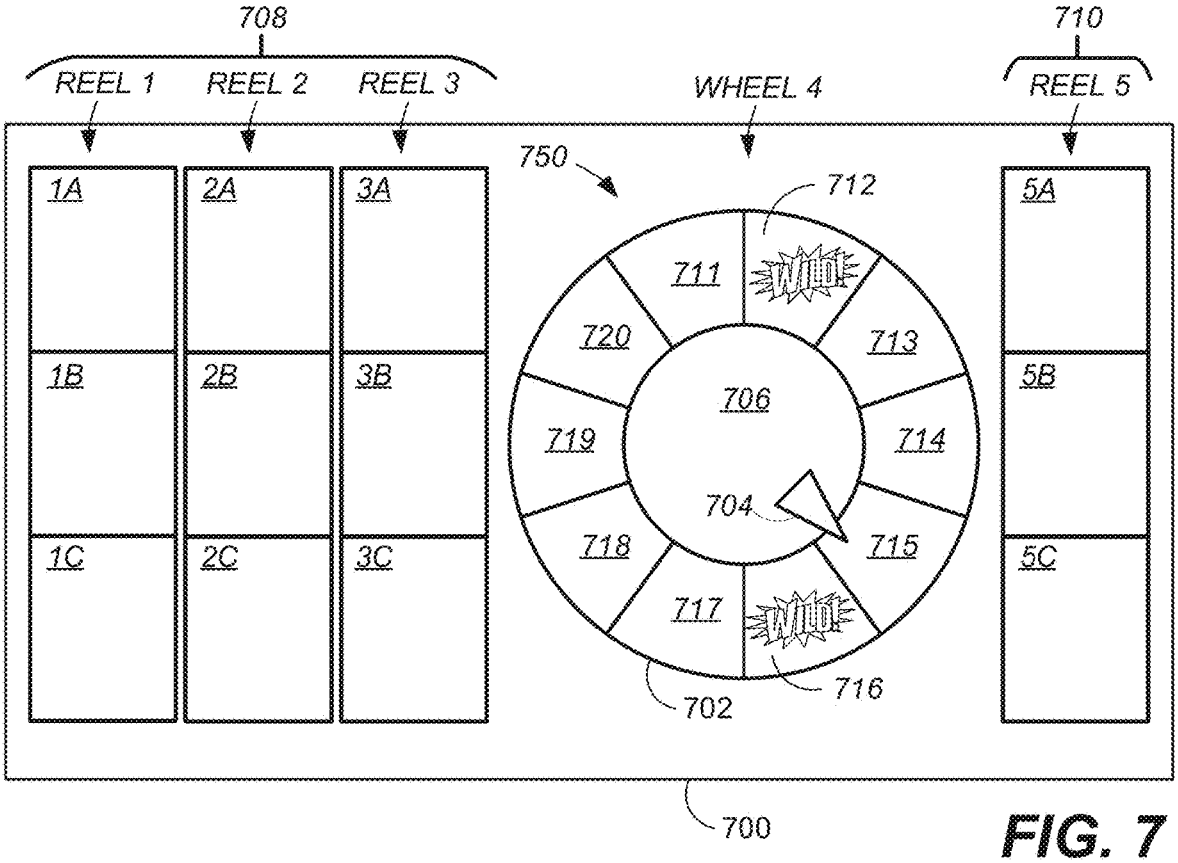
FIG. 7 is a block representation of an example display screen integrating a static wheel layout in a slot game.

In some examples, the game controller 202 may determine the second set of display symbols by selecting a static wheel layout of a plurality of predetermined wheel layouts (e.g., see illustrated example of FIG. 7). For example, the game controller 202 might have access to twenty static wheel layouts, each with a different expected probability and/or value, and the game controller 202 selects the wheel layout based on a weighted table per game basis (wheel layouts with a lower expected value are weighted more heavily than wheel layouts with a higher expected value). Some embodiments may combine more than one of these options. For example, the game controller 202 could use a layout that designates specific display symbols for specific wheel slices, and the remaining wheel slices may be dynamically populated with symbols from the first set of display symbols of the preceding reels (or otherwise populated).

Figure 5C:
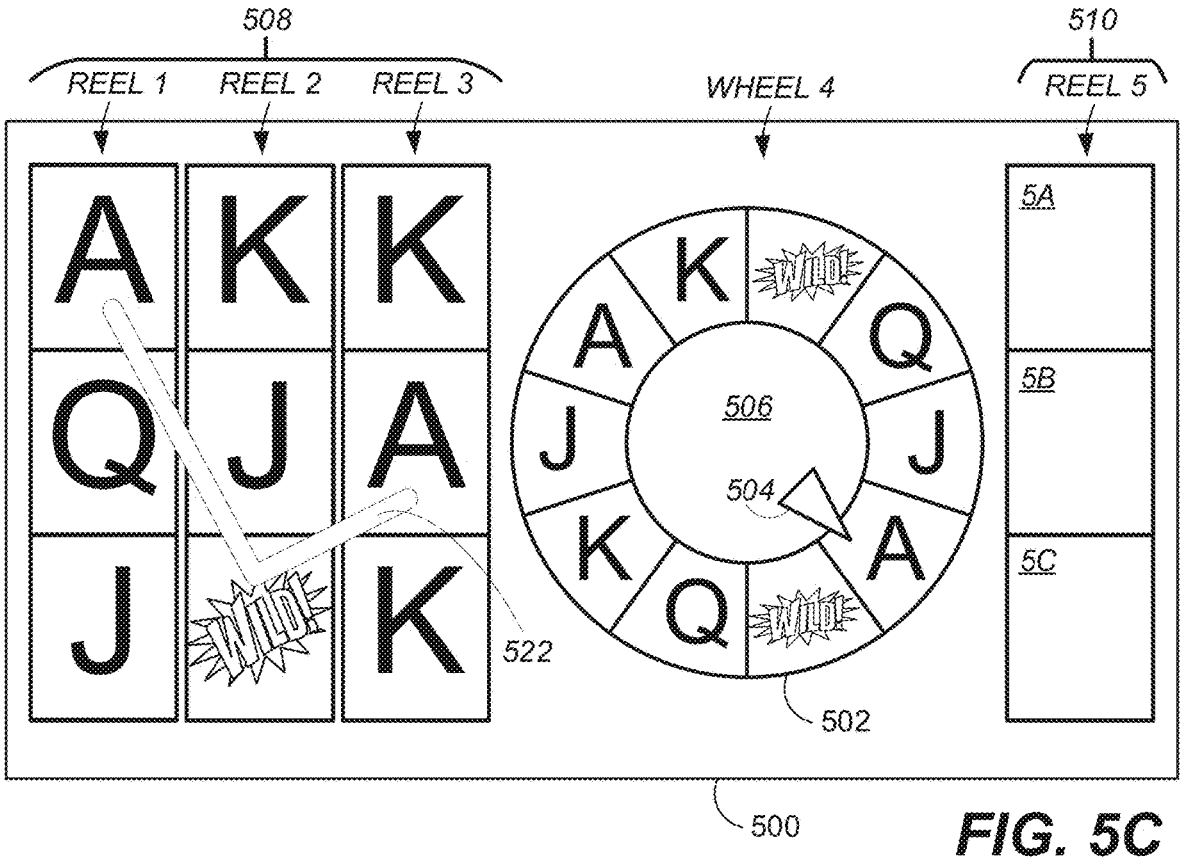
Figure 5D:
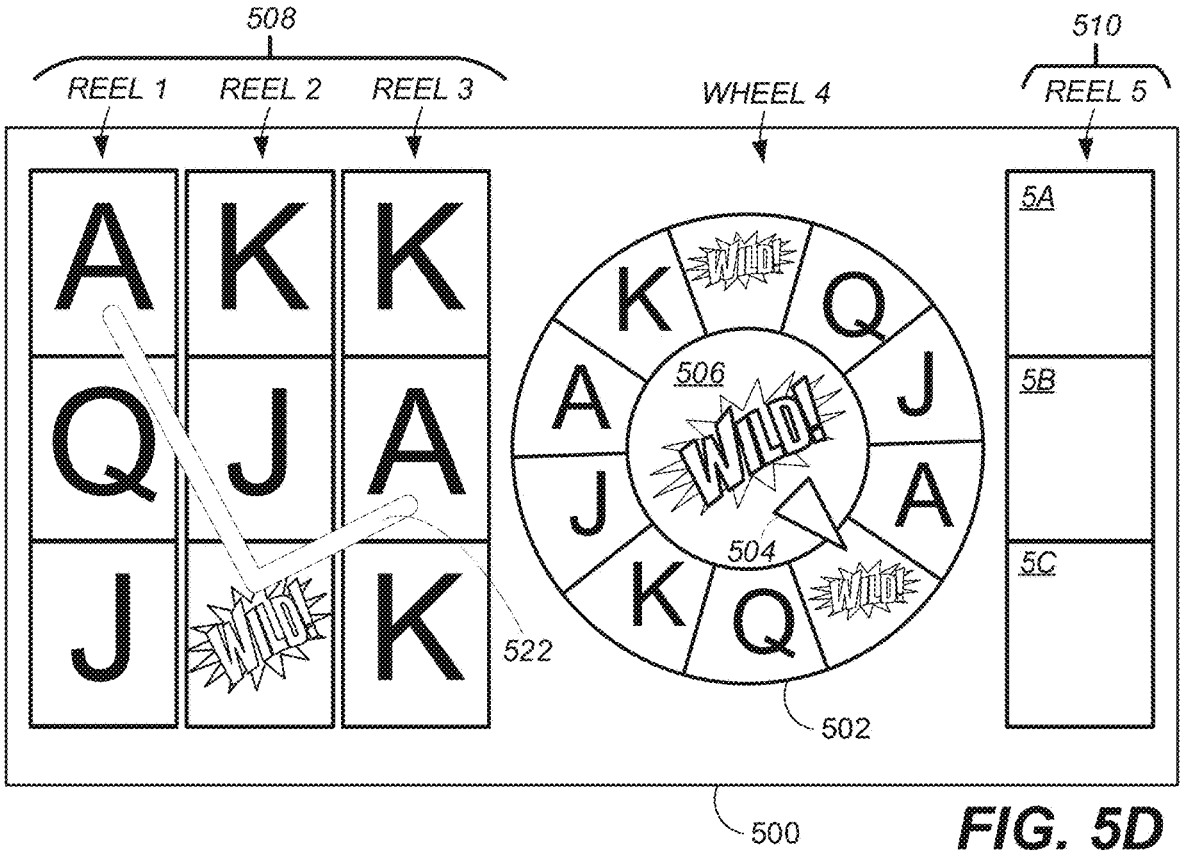

At 408, the game controller 202 determines a symbol outcome for the wheel (e.g., see illustrated example of FIG. 5D). The game controller 202 selects one of the second set of display symbols as the symbol outcome of the wheel. For example, the game controller 202 can select the symbol outcome using the RNG engine 316. In some examples the wheel spin is a fair wheel where all slices have the same probability of indexing. In other examples, the wheel spin is a weighted wheel where different slices of the wheel are assigned differing probabilities of indexing, through reference for example, to a weighted table, as described with reference to FIG. 2A above.

At 410, the game controller 202 determines a third set of display symbols for one or more subsequent reels (e.g., see illustrated example of FIGS. 5E-6B). In at least one example, the third set of display symbols is selected from the full symbol set or a subset of the full symbol set. In at least one example, the game controller 202 determines the third set of display symbols at the same time as the first set of display symbols. In some examples the third set of display symbols includes a cross-symbol mapping of the symbol outcome of the wheel to a subsequent reel (e.g., see illustrated example of FIGS. 5E-5H, and 5J-6B). For example, for a wheel in the third reel position of five total reel positions, such that the wheel is positioned between two preceding reels and two subsequent reels, the symbol outcome of the wheel may be mapped to all display symbol locations of the third reel positioned in the fourth reel position, while the fourth reel in the fifth reel position does populate with the symbol outcome of the wheel. In some examples in which cross symbol mapping is utilized, the symbols may be mapped from the wheel to a reel that is not adjacent the wheel.

At 412, the game controller 202 performs a pay evaluation applying the symbol outcome between the one or more preceding reel outcomes and the one or more subsequent reel outcomes. In some examples, the value of the symbol outcome of the wheel is applied more than once. For example, where the preceding reels define a matrix including three rows of symbol positions, the wheel symbol outcome may be applied as an extension of each horizontal row (in a manner analogous to representing a vertical stack of the wheel outcome symbol). Thus, in at least one example, the value of the symbol outcome is applied a number of times equal to a number of symbol positions for each reel outcome. The symbol outcome of the wheel connects win paths from the preceding reels to the subsequent reels, where applicable.

The term "win path" as used herein includes any indication of a win condition and can include any of a variety of display animations. win pathIn general, after reel outcomes have been determined (e.g. reels have landed or stopped at display symbols) any win conditions can be detected and any win amounts can be awarded to the player (e.g., credited to the player's credit balance). In some examples, win conditions depend on a count of target symbols in a reel area. In other examples, win conditions are defined as win paths (also called win lines) across at least a portion of a reel area on a display screen. For a round of play, when a certain combination of symbols appears along a win path, a win amount corresponding to that combination of symbols and that win path is awarded. Win amounts can vary according to the combination of symbols and according to the particular win path along which the combination of symbols appears. Win amounts are typically determined according to a pay table, where the pay table comprehends the various combinations of symbols and win paths that may occur (i.e., the win conditions). The win amount for a round of play may be a fraction of an amount wagered for that round of play for certain win conditions. For other win conditions, the win amount may be much larger than the amount wagered. The number of win paths and base credit cost to play depends on implementation. In an example implementation, there are 50 win paths and a 150 credit cost. There are 2×, 3×, 4×, and 5× bet multipliers (also called bet levels), which sets a max bet of 650 credits. Multipliers can also appear as symbols in reels. Alternatively, there could be higher bet multipliers (e.g., up to 8×, with a max bet of 1200 credits), different credit options, and/or a different number of win paths.

Instead of evaluating win conditions on win paths across reels in a reel area, an award can be determined according to a "ways" (or all-ways) approach. In some examples, a player may obtain a win entitlement by selecting a number of reels to play and an amount to wager per reel. The selection of a reel means that each displayed symbol of the reel (in the reel area) can be substituted for a symbol at one or more designated display positions. In other words, all symbols displayed at symbol display positions in the reel area for a selected reel can be used to form symbol combinations (one symbol per reel in a combination) with any of the symbols displayed at designated, symbol display positions of each of the other reels. For example, if there are five reels and three symbol display positions for each reel in a reel area (such that the symbol display positions comprise three rows of five symbol display positions), the symbol displayed in the center row is used for a non-selected reel, and the symbols displayed in all three rows are used. for a selected reel. Each possible path through the designated (active) symbol display position(s) of the respective reels provides a way to win. As a result, the total number of ways to win is determined by multiplying the number of active display position(s) of each reel, where the active display position(s) for a reel are all display positions in the reel area for a selected reel but only the designated (e.g., center) display position in the reel area of a non-selected reel. As a result, for five reels and fifteen display positions, there are 35=243 ways to win if five reels are selected, 3×3×3×1×1=27 ways to win if three reels are selected, and so on. In some examples, paying on ways means a player wins on any left-to-right path (for vertically oriented reels in a horizontal layout) starting from the first reel.

The systems and methods of the present disclosure include any pay evaluation, including win paths, target symbol count, and ways pay. Further, for the purposes of this disclosure the term "win pathwin path" can be used for win path, target symbol count, and ways pay evaluations to indicate winning outcomes.

At 414, the game controller 202 controls a display system to display the game (or instance) outcome, which includes not only the preceding reel outcome as discussed, but also the wheel symbol outcome, and the subsequent reel symbol outcome. Generally, the game controller 202 via the game processing architecture 300 will control a display system (for example primary game display 240 and secondary game display 242 of gaming device 200) to display a user interface for each game instance of a base, secondary, and/or bonus game. The game controller 202 controls the display system to display the game outcome including the wheel positioned between the preceding reels and the subsequent reels as well as the relevant display symbols and the symbol outcome. The game controller 202 can further control the display system to display win paths where applicable (e.g., see illustrated example of FIGS. 5B-5F and 5H). In some examples, the game controller 202 controls the display system to display one or more outcomes of the game sequentially as they are determined by the game controller 202, periodically, or otherwise. Such sequential (i.e. incremental) display of the components of the game or instance outcome can guide the player through the outcome generation, thereby again improving the player's interest in the progress toward the game or instance outcome.

Figure 4B:
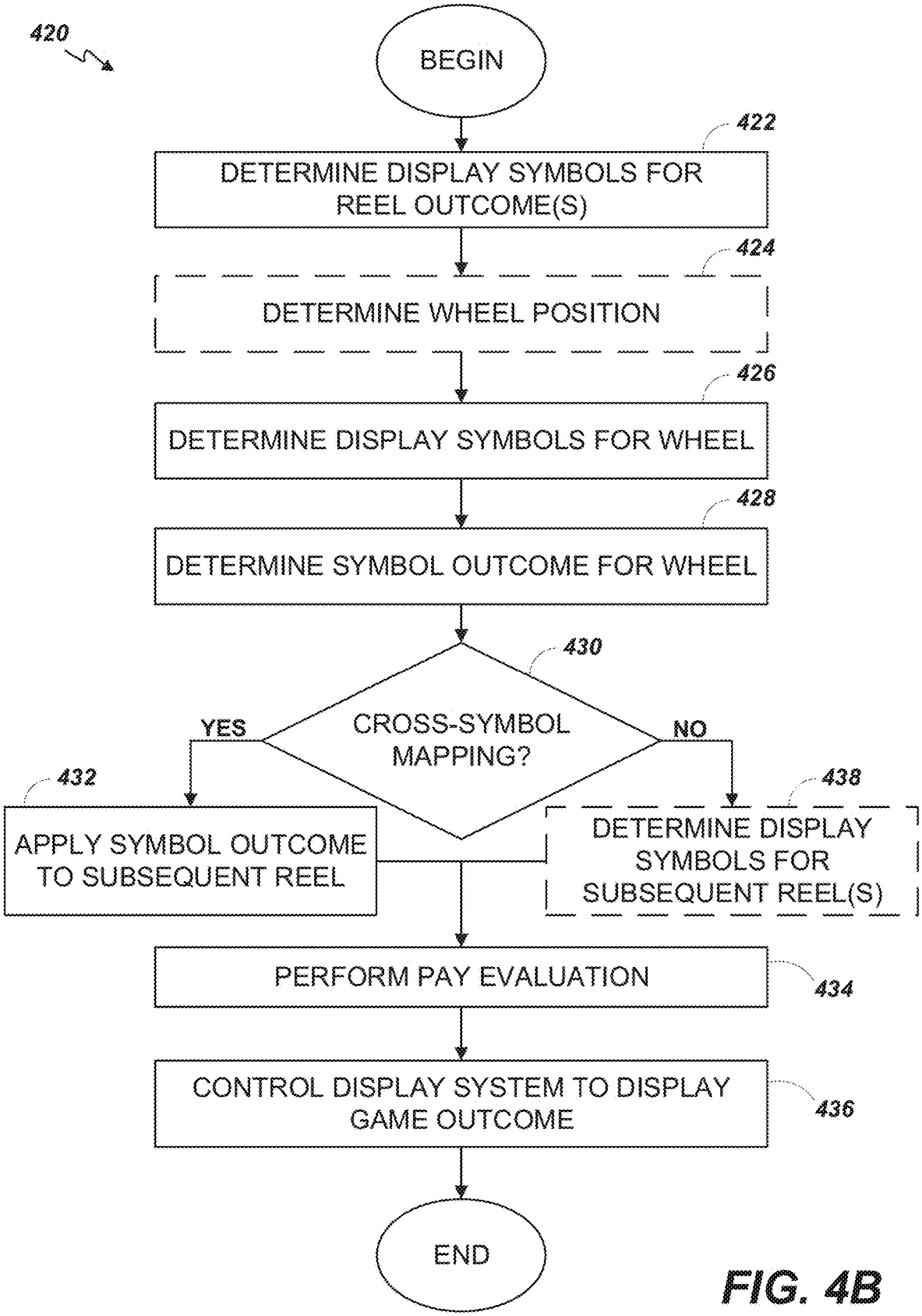

FIG. 49 is a flowchart illustrating an example method 420 for integrating a wheel between reels in a slot game, the method 420 including a cross-symbol mapping decision to allow for cross-symbol mapping as a bonus while controlling the rate of use. Many of the variations and possibilities described with regard to the method 400 of FIG. 4A also apply to the method 420 of FIG. 4B, though not be repeated here, for clarity. In at least one example, the method 420 begins with a player initiating a spin.

At 422, the game controller 202 determines the display symbols for one or more reels, to the extent not previously established. This can include both the set of display symbols for one or more preceding reel outcomes and the set of display symbols for one or more subsequent reel outcomes.

At 424, the game controller 202 optionally determines a wheel position. See description regarding determining a wheel position with regard to FIG. 4A.

At 426, the game controller 202 determines a set of display symbols for the wheel. In at least one example, the display symbols may be selected and dynamically mapped to the slices of the wheel from the symbols displayed at the one or more preceding reel outcomes (e.g., see illustrated example of FIG. 5C). Other manners in which the game controller 202 can determine the set of display symbols for the wheel are discussed with reference to FIG. 4A.

At 428, the game controller 202 determines a symbol outcome for the wheel by selecting one symbol of the set of display symbols displayed at the wheel. (e.g. see illustrated example of FIG. 5D).

At 430, the game controller 202 determines whether cross-symbol mapping should apply. The game controller 202 can occasionally on a random basis decide to push the symbol outcome from the wheel to a subsequent reel of the one or more subsequent reels as an added bonus to the player. To control the rate of cross-symbol mapping, an additional RNG pull can be utilized to determine whether to perform cross-symbol mapping. The hit rate for cross-symbol mapping could vary depending on whether playing a base game, a secondary game, or a bonus game. For example, the hit rate cross-symbol mapping could be set to 1/300 in a base game and have a hit rate of 1/4 in a free game bonus feature. Generally, the hit rate is a measured approximate number. The game architecture 300 as described in FIG. 3 can control the hit rate based on assigned weights in one or more weighted tables.

If the game controller 202 determines that cross-symbol mapping does not apply, then the method 420 optionally proceeds to 438 if the third set of display symbols for the one or more subsequent reel outcomes has not yet been determined, otherwise, the method 420 proceeds to 434. At 438, the game controller determines a third set of display symbols for one or more subsequent reel outcomes. In at least one example the third set of display symbols is selected from the full symbol set or a subset of the full symbol set.

At 432, the game controller 202 performs cross-symbol mapping, applying the symbol outcome of the wheel to a subsequent reel. For example, for a wheel in a third reel position of five reel positions, the symbol outcome of the wheel may be mapped to all display symbol locations of the third reel in the fourth reel position (e.g., see FIG. 5J). As another example, for a wheel in a fourth reel position of five reel positions, the symbol outcome of the wheel may be mapped to all display symbol locations of the fourth reel in the fifth reel position (e.g. see FIGS. 5E-5H). In both examples, the symbol outcome would be repeated for the wheel and the relevant subsequent reel. In some examples, the wheel symbol outcome could be mapped to multiple subsequent reels (or to selected display positions on multiple reels).

At 434, the game controller 202 performs a pay evaluation applying the symbol outcome between the one or more preceding reel outcomes and the one or more subsequent reel outcomes. At 436, the game controller 202 controls the display system to display the game outcome. Both the pay evaluation and the control of the display are discussed in greater detail with regard to FIG. 4A.

Figure 4C:
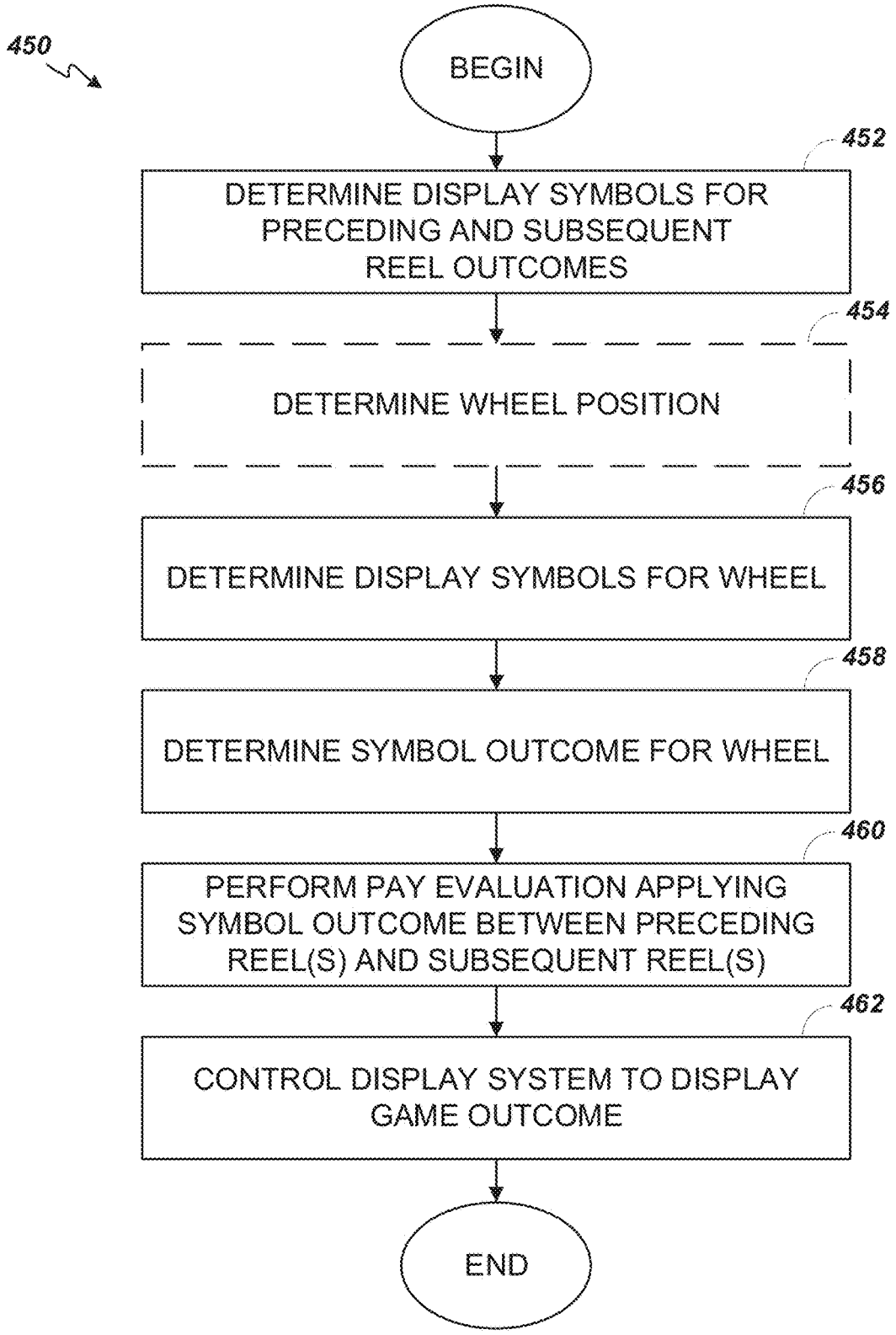

FIG. 4C is a flowchart illustrating an example method 450 for integrating a wheel between reels of a slot game that includes determining the preceding and subsequent reel outcomes at the same step and does not include cross-symbol mapping to a subsequent reel. Many of the variations and possibilities described with regard to the method 400 of FIG. 4A also apply to the method 450 of FIG. 4C, though they may not be repeated here. Prior to the start of method 450, the gaming device 200 may begin game play responsive to initiation of a spin by the player.

At 452, the game controller 202 determines display symbols for one or more preceding reel outcomes and one or more subsequent reel outcomes.

At 454, the game controller 202 optionally determines a wheel position. In the case of a game utilizing a static wheel position, the method 450 proceeds directly from 452 to 456. In some examples the game controller 202 determines the wheel position prior to determining the display symbols for the reel outcomes. Since the preceding and subsequent reel outcomes are both populated with display symbols prior to the controller determining the wheel position, the wheel position can be determined to be between existing reels or an existing reel can be removed to make room for the wheel.

At 456, the game controller 202 determines a second set of display symbols for the wheel. The wheel has a plurality of slices that can be populated with display symbols in various manners depending on the embodiment as described with reference to FIG. 4A.

At 458, the game controller 202 determines a symbol outcome for the wheel by selecting one symbol of the set of display symbols displayed at the wheel. (e.g. see illustrated example of FIG. 5D).

Figure 4D:
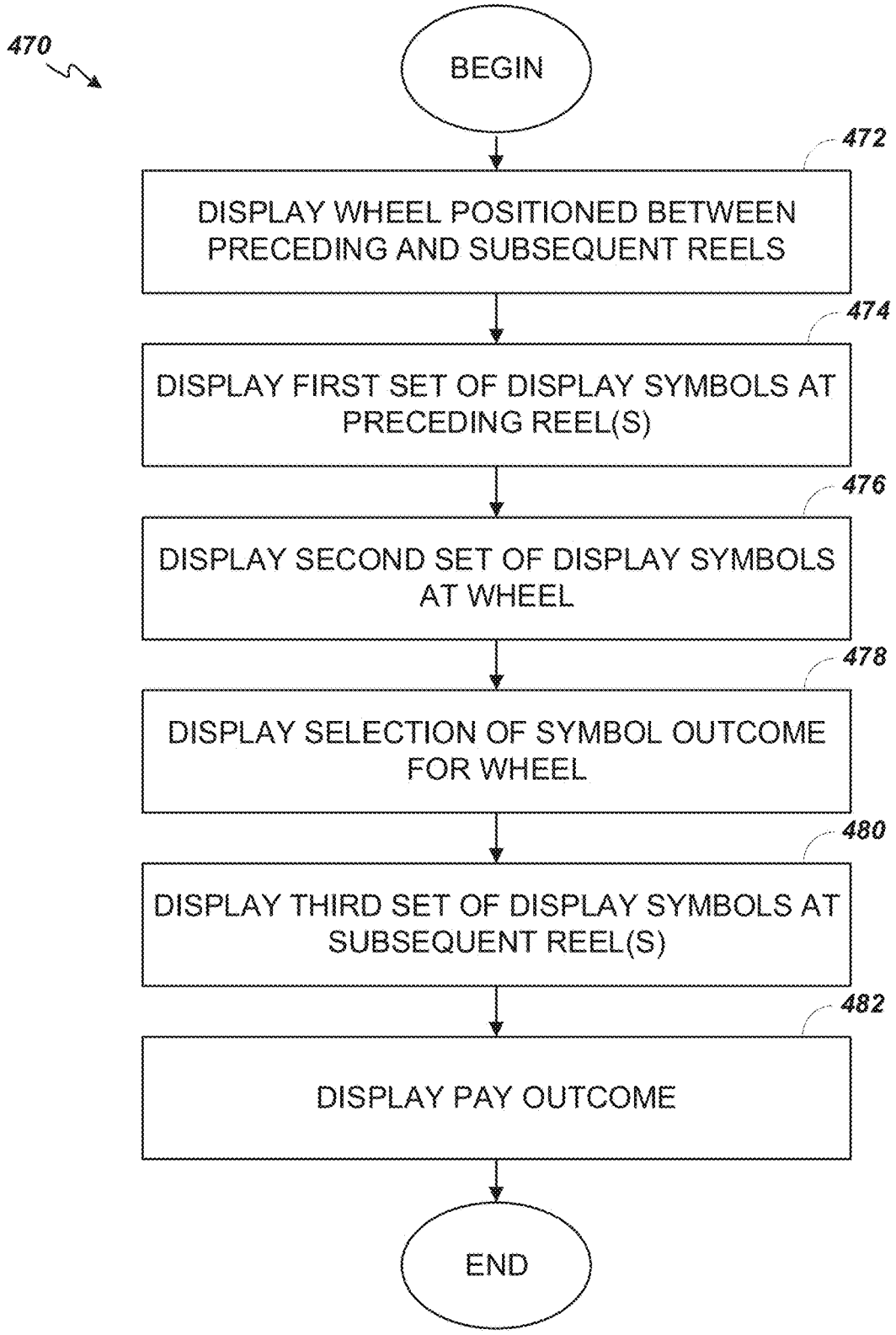

At 460, the game controller 202 performs a pay evaluation applying the symbol outcome of the wheel between the one or more preceding reel outcomes and the one or more subsequent reel outcomes. Since no cross-symbol mapping occurs, the one or more subsequent reels are populated independently of the symbol outcome of the wheel (e.g. see illustrated example of FIG. 5I). At 462, the game controller 202 controls the display system to display the game outcome. Both the pay evaluation and the control of the display are discussed in greater detail with regard to FIG. 4A FIG. 4D is a flowchart illustrating an example method 470 for displaying integration of a wheel between reels of a slot game. In some embodiments, method 470 may correspond to block 414 of FIG. 4A, block 436 of FIG. 4B, and/or block 462 of FIG. 4C. Generally, prior to the start of method 470, the gaming device 200 may begin game play by receiving a player initiation of a spin.

At 472, the game controller 202 controls the display system to display the wheel positioned between the one or more preceding reels and the one or more subsequent reels. The gaming device 200 may display the wheel at a first position between a first number of preceding reel(s) and a first number of subsequent reel(s) for a first game instance and at a second position between a second number of preceding reel(s) and a second number of subsequent reel(s) for a second game instance. The game controller 202 can control the display system to display a previous game outcome or other placeholder symbols until the spin begins.

At 474, the game controller 202 controls the display system to display the first set of display symbols at the preceding reels as part of a game outcome. Prior to displaying the first set of display symbols the display system may display spinning or flashing symbols indicating the spin, eventually landing on the first set of display symbols for the one or more preceding reels.

At 476, the game controller 202 controls the display system to display the second set of display symbols at the wheel. If the second set of display symbols includes one or more symbols mapped from the first set of display symbols, the game controller 202 can control the display system to display a visual indicator showing the mapping of the one or more symbols.

At 478, the game controller 202 controls the display system to display selection of the symbol outcome for the wheel. The display system can show the wheel spinning and/or the slices flashing to indicate the spin. In some examples, the game controller 202 controls the display system to display selection of the symbol outcome responsive to a user input. For example, the player may spin a mechanical wheel, turn a dial, use a slingshot, pull a lever, use one or more touch gestures, such as a swipe or a drag and pull, or use another wheel actuator. For the purposes of this disclosure a slingshot refers to a pull-back motion such that release of the pull-back motion causes an acceleration (real or simulated) in the opposite direction of the pull. For example, the slingshot could involve a touchscreen or touchpad and a user can gesture with a finger to pull-back and release according to correspond to a movement of the wheel. The user input can be provided via the user interface system 302, for example buttons 236 of the gaming device 200, which may include the wheel, turn dial, slingshot device, lever, touch screen, touchpad, or other wheel actuator. In at least one example, the user input can control an appearance of the movement of the wheel. For example, the wheel may spin faster responsive to the further back the slingshot is pulled. In at least one example, the player spins a wheel. In such an example the symbols may still be digitally displayed on the wheel. The use of a wheel actuator can provide the player with a sense of skill even though results are randomly generated.

The game controller 202 controls the display system to display the selection of the symbol outcome of the wheel by use of an indicator. The indicator may be any of a variety of options to indicate to the player that a given display symbol of the second set of display symbols is the symbol outcome. For example, the indicator could be an arrow, a pointer, a color change, a sound, an outline, movement of the selected symbol, flashing of the symbol, a combination of these, or the like.

At 480, the game controller 202 controls the display system to display the third set of display symbols at the subsequent reels and corresponding to the game outcome. In some examples, cross-symbol mapping takes place such that the display system displays the symbol outcome from the wheel to a subsequent reel of the one or more subsequent reels. In such an example, the display system may display a visual indication of this cross-symbol mapping, so the player knows where the symbols came from.

Figure 4E:
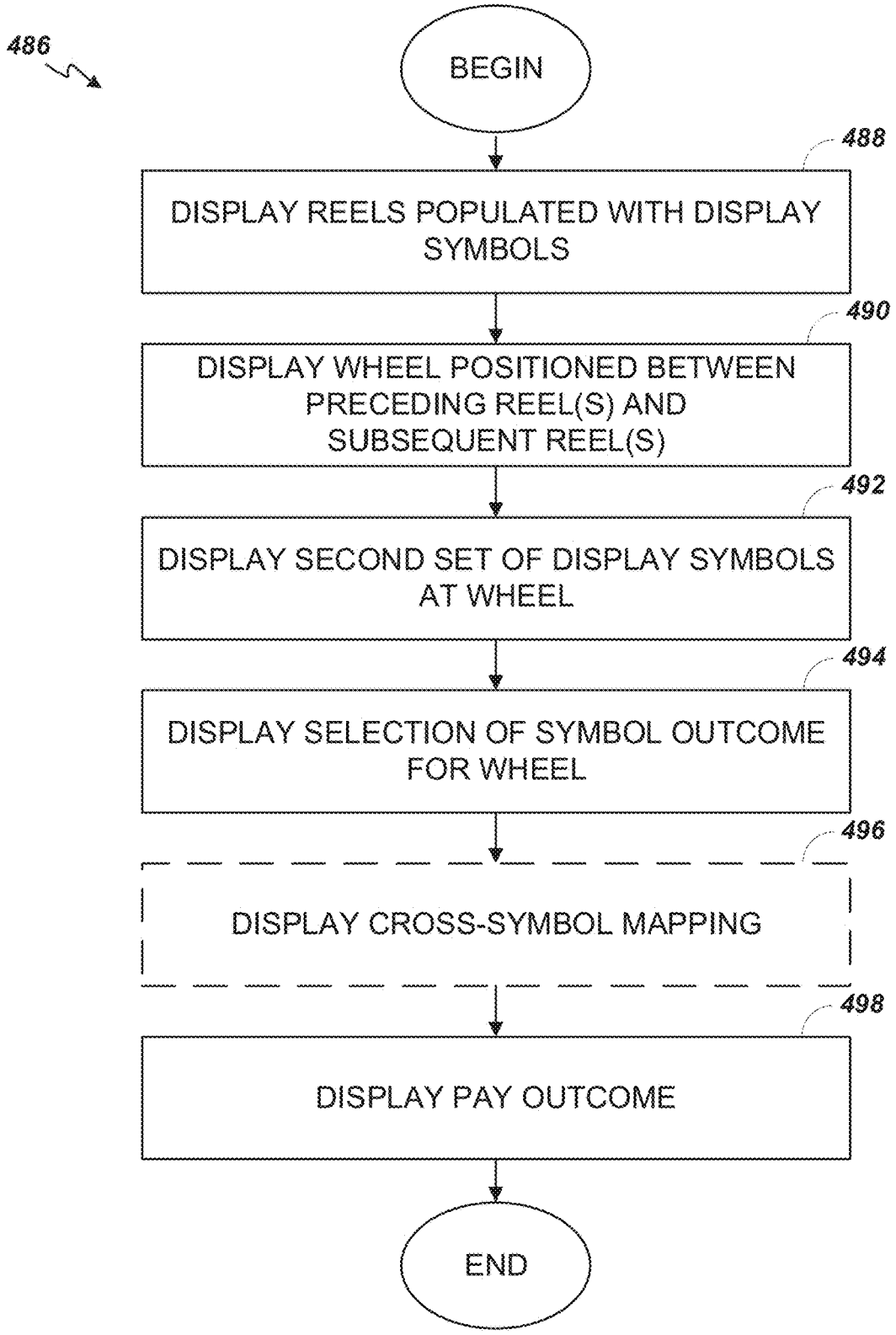

At 482, the game controller 202 controls the display system to display the pay outcome. For example, the display system may display one or more win paths where applicable. The pay outcome may be displayed such that one or more win paths extends from a preceding reel through the wheel to a subsequent reel. In at least one example, the display system displays the symbol outcome such that the symbol outcome is repeated for the same number of rows (or columns) of symbols that each reel has. Both the pay evaluation and the control of the display are discussed in greater detail with regard to FIG. 4A FIG. 4E is a flowchart illustrating an example method 486 for displaying integration of a wheel between reels of a slot game that includes displaying the wheel position after populating one or more reels and the option for displaying cross-symbol mapping (e.g. depending on whether the game controller 202 determines cross-symbol mapping applies). The description with regard to method 470 of FIG. 4D should be referenced for variations to method 486 that have not been repeated here. In some embodiments, method 486 may correspond to block 414 of FIG. 4A, block 436 of FIG. 4B, and/or block 462 of FIG. 4C. Generally, prior to the start of method 400, the gaming device 200 may begin game play, e.g. by a player starting a spin.

At 488, the game controller 202 controls the display system to display the reels populated with the display symbols for a game outcome. In some examples, this includes the one or more preceding reels and the one or more subsequent reels.

At 490, the game controller 202 controls the display system to display the wheel positioned between the preceding reels and the subsequent reels. In at least one example, the display system may separate the one or more preceding reels and the one or more subsequent reels to make room for the wheel. In some examples, the display system may remove a reel and replace to make room for the wheel. In at least one example the display system already displayed the wheel on the display but moves it to the correct position. In some examples, the display system displays the wheel in a first position a first instance and a second position a second instance, where the first and second positions are different.

At 492, the game controller 202 controls the display system to display the second set of display symbols at the wheel.

At 494, the game controller 202 controls the display system to display selection of the symbol outcome for the wheel.

At 496, the game controller 202 optionally controls the display system to display cross-symbol mapping of the symbol outcome to a subsequent reel. In some examples, cross-symbol mapping takes place such that the display system displays the symbol outcome from the wheel to a subsequent reel of the one or more subsequent reels. In such an example, the display system may display a visual indication of this cross-symbol mapping to indicate this added bonus to the player.

At 498, the game controller 202 controls the display system to display the pay outcome. In many embodiments display include updating a displayed credit counter. Both the pay evaluation and the control of the display are discussed in greater detail with regard to FIG. 4A. While the various methods described with reference to FIGS. 4A-4E are provided in the context of a slot type game, the methods are not limited to this game type and the concepts may similarly apply to other game types, such as keno, video poker, video blackjack, pachinko, etc. Further, any one or more of the display processes described with reference to FIGS. 4A-4E may be accomplished through or otherwise involve animation effects (animations).

FIGS. 5A-5K are block representations of example display screens 500 integrating a wheel 502 in a slot game having five reel positions. FIG. 5A is a block representation of an example display screen 500 with a wheel 502 positioned at the fourth reel position. The illustrated example includes reels 1, 2, 3 as preceding reels 508 leading the wheel 502 (preceding reels, as discussed herein) and reel 5 as a subsequent reel 510 following the wheel 502. Each of the reels includes three rows of symbol positions A, B, C. For example, Reel 1 includes symbol positions 1A, 1B, 1C. However, other examples may have more or fewer reels, and each reel may have greater or fewer symbol positions. In the illustrated example, the wheel 502 has ten slices, 511, 512, 513, 514, 515, 516, 517, 518, 519, 520, however other examples may include more or fewer slices per wheel 502, such as nine slices (for example to match the number of symbol positions of the preceding reels), or another selected number. In at least one example, the number of slices may change with different instances of a game, or when switching between a base game, a secondary game, and/or a bonus game. The wheel 502 further includes an indicator 504 for selecting the symbol outcome of the wheel 502 and a symbol outcome space 406 for displaying the symbol outcome once selected. In other examples, the wheel 502 may include a different indicator 504 and/or a different symbol outcome space 406 or way of displaying the symbol outcome once selected. The illustrated example display screen 500 is shown pre-spin with blanks in all of the slices 511-520 and all of the symbol positions 1A, 2A, 3A, SA, 1B, 2B, 3B, 5B, 1C, 2C, 3C, 5C. However, in other examples, the pre-spin display screen 500 may show the previous game outcome or one or more placeholders. In at least one example, the pre-spin display screen 500 may show flash symbols as a placeholder. In at least one example, the wheel 502 flashes symbols until the preceding reels 508 land.

FIG. 5B is a block representation of the example display screen 500 of FIG. SA after a spin. The preceding reels 508 are shown populated with the first set of display symbols J, Q, K, A, WILD! which may be a subset of a full symbol set of the gaming device 200 and correspond to the preceding reel outcomes. The illustrated example already shows one win path 522 for the preceding reels 508, even though the wheel 502, and the subsequent reel 510 have not been populated yet. In other examples, the display screen 500 only shows pay outcome such as win path 522 when the full game outcome is displayed. The illustrated win paths indicate winning outcomes based on a "ways" pay evaluation. However, a traditional win path pay evaluation or other pay evaluation is also contemplated.

FIG. 5C is a block representation of the exemplary display screen 500 of FIGS. 5A and 5B after the wheel 502 has been populated with the second set of display symbols. In the illustrated example, the wheel 502 is dynamically populated with the first set of display symbols. That is, the display symbols that have populated the preceding reels 508 (A, Q, J, K, J, WILD!, J, A, J) are used to populate the slices of the wheel 502. In at least one example, a lookup table can be used to determine the symbol that populates on a given wheel slice. After the slices of the wheel 502 are populated, the wheel can spin to select the symbol outcome 506. In some examples the wheel automatically spins. In other examples, the player can initiate spinning of the wheel 502 via the user interface, as previously discussed relative to FIG. 4D.

In at least one example, the game controller 202 utilizes a wheel layout operation to determine the arrangement of display symbols that populate the slices of the wheel 502. In at least one example, the wheel layout operation can space symbols apart from each other, for example to eliminate or reduce like symbols being placed adjacent to one another. For example, the game controller 202 might put at least two slices between any two WILD! symbols. In some examples, the wheel layout operation can space high paying symbols (which may be different symbols) apart from each other. For example, if the A symbol and the WILD! symbol are high paying symbols, the wheel layout operation can space apart the all instances of A and WILD! on the wheel. The wheel layout operation can utilize a minimum threshold spacing rule and/or can always maximize the spacing. In one or more embodiments, game designers may implement operations that produce results described above based on one or more software modules, programs, and/or functionality known by a person of ordinary skill in the art.

The wheel 502 may spin (or appear to spin) in either direction. In at least one example, the indicator 504 spins instead of the wheel 502 itself. In at least one example both the indicator 504 and the wheel 502 move. The wheel may move in any of a variety of manners other than, or in addition to, spinning, for example, the wheel can bounce around the screen.

FIG. 5D is a block representation of the example display screen 500 of FIGS. 5A-5C after selection of a symbol outcome 506 for the wheel 502. The game controller 202 controls the display system to display the selection of the symbol outcome of the wheel by use of an indicator 504. The indicator 504 may be any of a variety of options to indicate to the player that a given display symbol of the second set of display symbols is the symbol outcome. For example, the indicator could be an arrow, a pointer, a color change, a sound, an outline, movement of the selected symbol, flashing of the symbol, a combination of these, or the like. In the illustrated example, the indicator 504 is a stationary pointer, and the wheel 502 spins about the wheel's axis such that each of the slices of the wheel 502 passes the indicator 504 until the wheel 502 stops. Whichever slice of the wheel 502 the indicator 504 points to is the symbol outcome 506 of the wheel 502. In the illustrated example, the symbol outcome 506 (in this case WILD!) is then displayed in the center of the wheel 502. In at least one example, the symbol outcome 506 of the wheel 502 is treated as a vertical stack of symbols. Thus, in the illustrated example the symbol outcome 506 of WILD! would be equivalent to having a vertical stack of WILD! symbols. In some examples the wheel 502 is a fair wheel in which all slices have the same probability of indexing. In other examples the wheel 502 is a weighted wheel in which various slices are assigned differing probabilities of indexing.

Figure 5E:
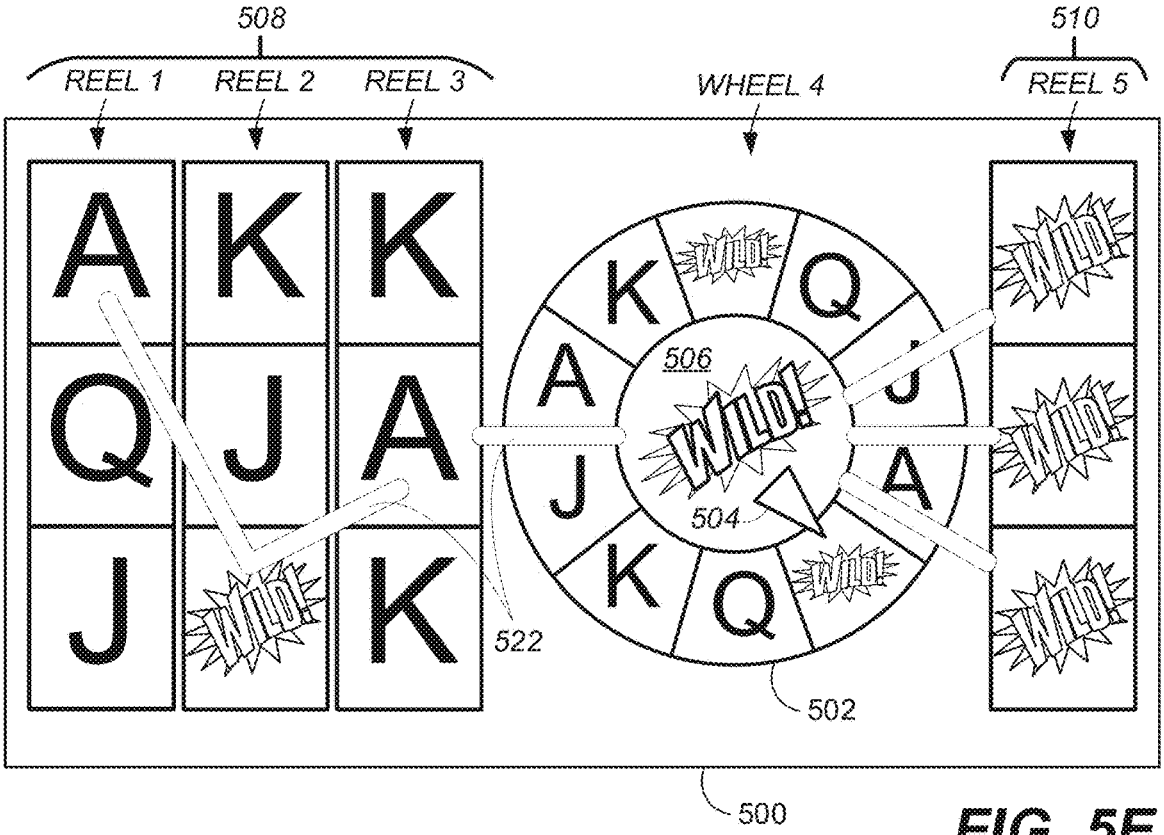

FIG. 5E is a block representation of the example display screen 500 of FIGS. 5A-5D after the game controller 202 performs cross-symbol mapping of the symbol outcome 506 to a subsequent reel 510. The symbol outcome 506 of WILD! has been mapped to each symbol space of reel 5. The game controller 202 has also performed a pay evaluation applying the symbol outcome 506 of the wheel 502 to the fourth reel position between the preceding reel outcomes and the subsequent reel outcome. As such, in the illustrated example, the wheel and reel 5 result in a total of six WILD! symbols for the purposes of pay evaluation. The win paths 522 can extend from the preceding reels 508 to the one or more subsequent reels 510 through the symbol outcome 506 of the wheel 502 positioned at the fourth reel position.

Figure 5F:
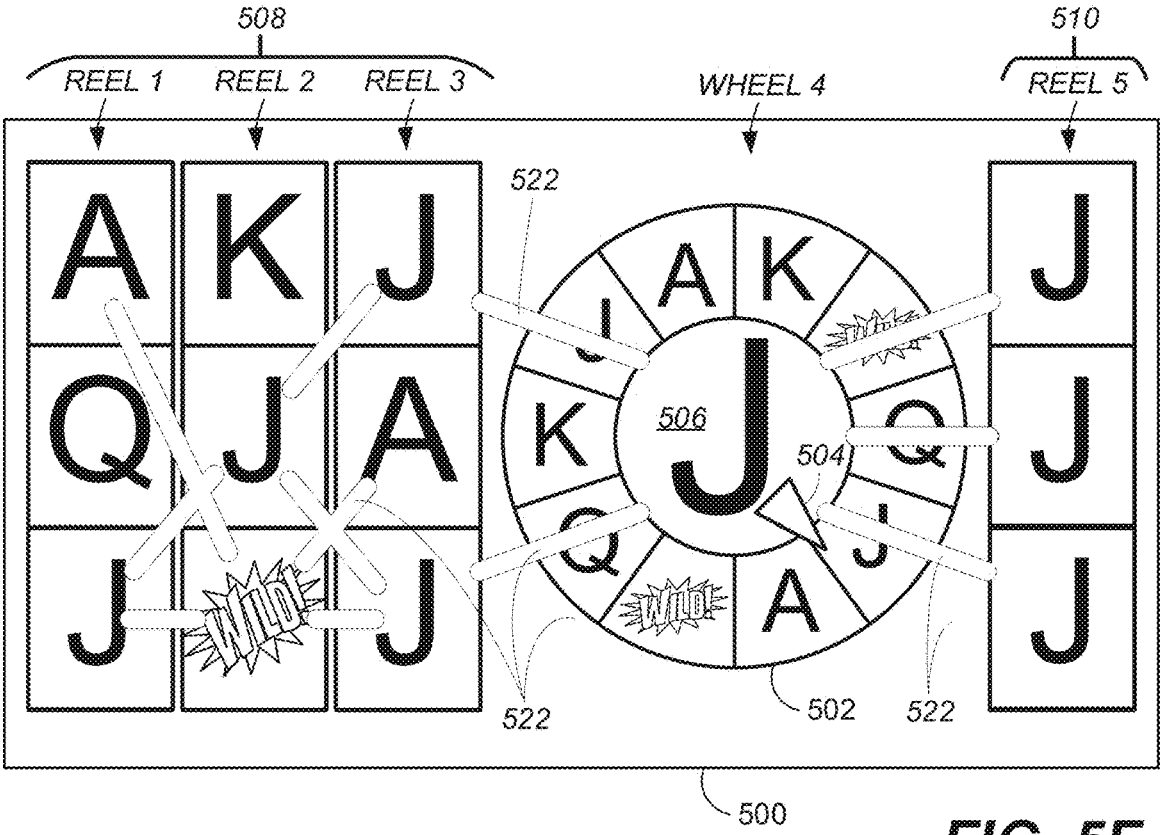

FIG. 5F is a block representation of an example display screen 500 if instead of landing on the WILD! in FIG. 5D, the symbol outcome 506 of the wheel 502 was a J. In the illustrated example cross-symbol mapping occurred to map the symbol outcome 506 to the subsequent reel 510. However, in other examples, the game controller 202 may perform a check to determine whether to perform cross-symbol mapping. Still in other examples the game controller 202 might not perform cross-symbol mapping at all. Based on the pay evaluation performed, a number of win paths 522 are displayed. The win paths extend from the preceding reels 508 to the subsequent reel 510 via the symbol outcome 506 of the wheel 502 positioned at reel 4.

Figure 5G:
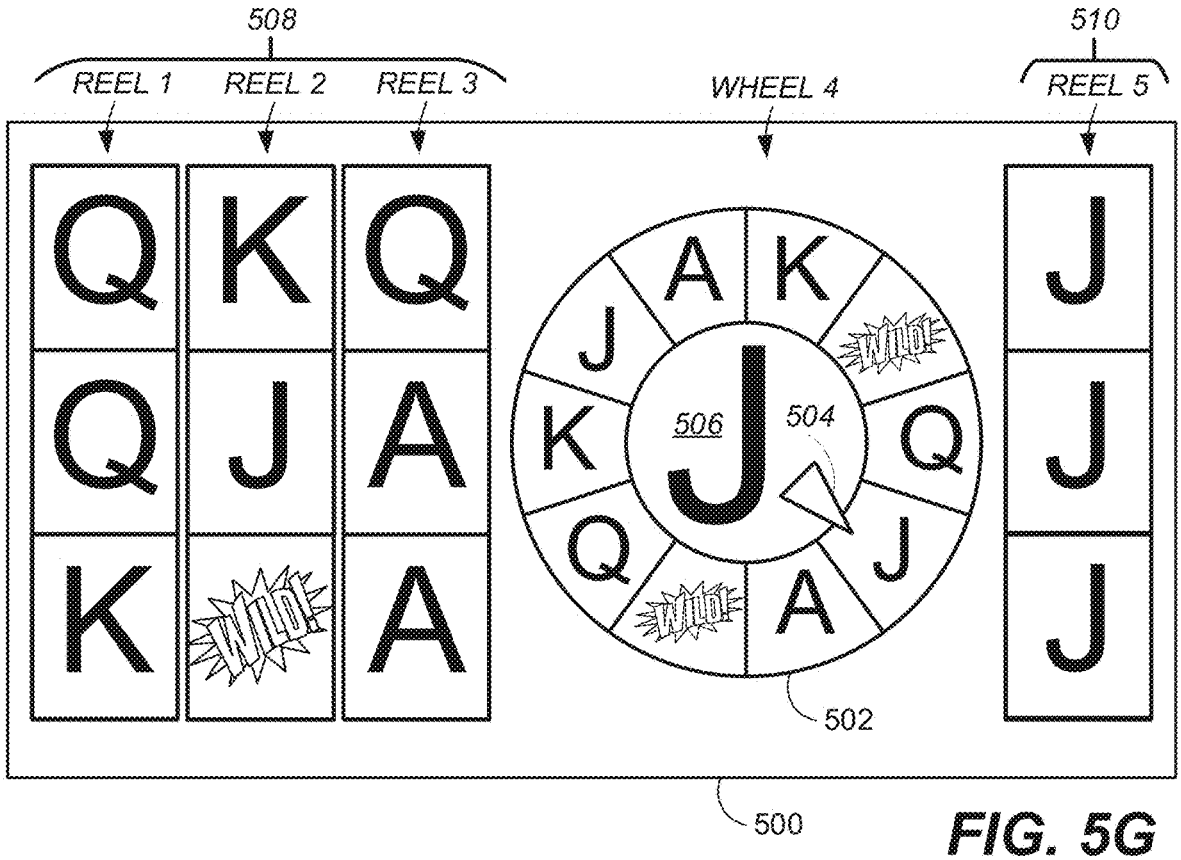

FIG. 5G is a block representation of an example display screen 500 of a non-winning spin. The symbol outcome 506 of the wheel 502 is a J, and the game controller 202 performed cross-symbol mapping to map the symbol outcome 506 to the subsequent reel 510, but no win paths resulted. This can represent the end of a game instance, a base game, a secondary game, and/or a bonus game.

Figure 5H:
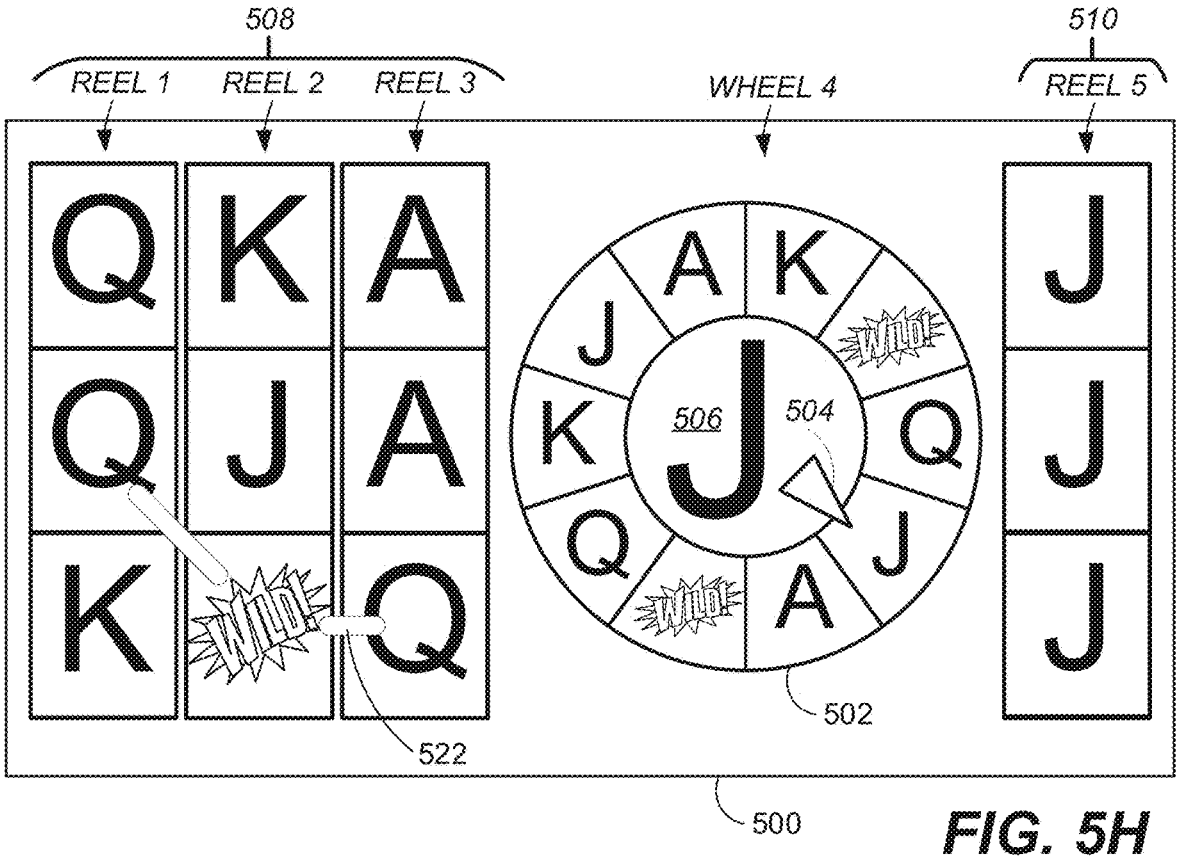

FIG. 5H is a block representation of an example display screen 500 of an alternative game outcome that only displays a winning outcome in the preceding reels 508. The symbol outcome 506 of the wheel 502 is a J, and the game controller 202 performed cross-symbol mapping to map the symbol outcome 506 to the subsequent reel 510, but the win path cannot extend from the preceding reels 508 to the subsequent reel 510 because the symbol outcome 506 in combination with the preceding reels 508 does not satisfy the pay evaluation rules for the game.

Figure 5I:
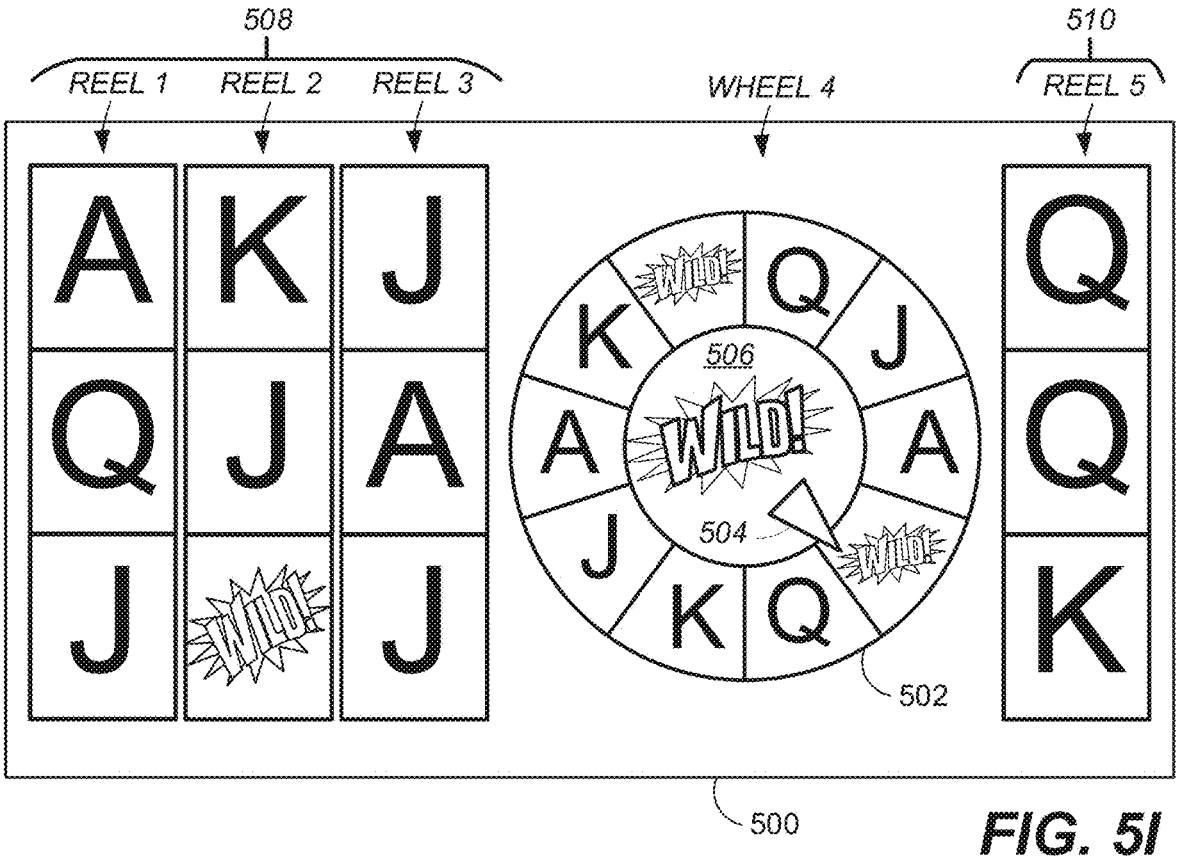

FIG. 5I is a block representation of an example display screen 500 where the game controller 202 does not perform cross-symbol mapping. The symbol outcome 506 is a WILD! but the controller 202 does not apply the symbol outcome 506 tot the subsequent reel 510. Instead the subsequent reel has been populated independent of the symbol outcome 506 of the wheel 502. In some examples the subsequent reel 510 is populated with display symbols at the same time as the preceding reels 508 are populated with display symbols. In another example, the subsequent reel(s) 510 is populated with display symbols selected from the full symbol set after the symbol outcome 506 has been selected. The illustrated example does not show the pay outcome.

Figure 5J:
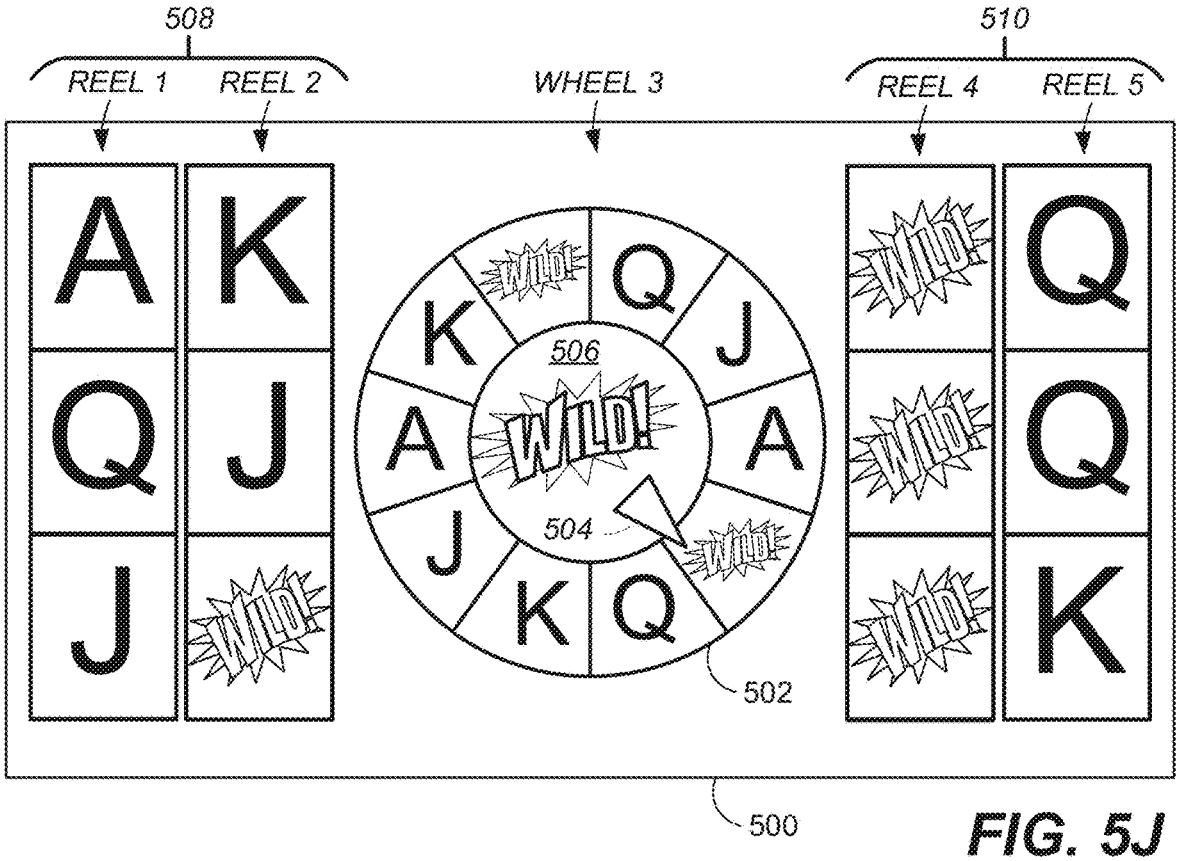

FIG. 5J is a block representation of an example display screen 500 illustrating that the wheel 502 can be in different positions such that different examples and different instances may include a different number of preceding and subsequent reels 508, 510. In at least one example the wheel 502 is never the first reel or the last reel. In the illustrated example the wheel 502 is positioned at the third reel position with two preceding reels 508 and two subsequent reels 510. In the illustrated example the game controller 202 has performed cross-symbol mapping to map the symbol outcome 506 to one subsequent reel (reel 4) of the subsequent reels 510. The illustrated example does not show the pay outcome.

Figure 5K:
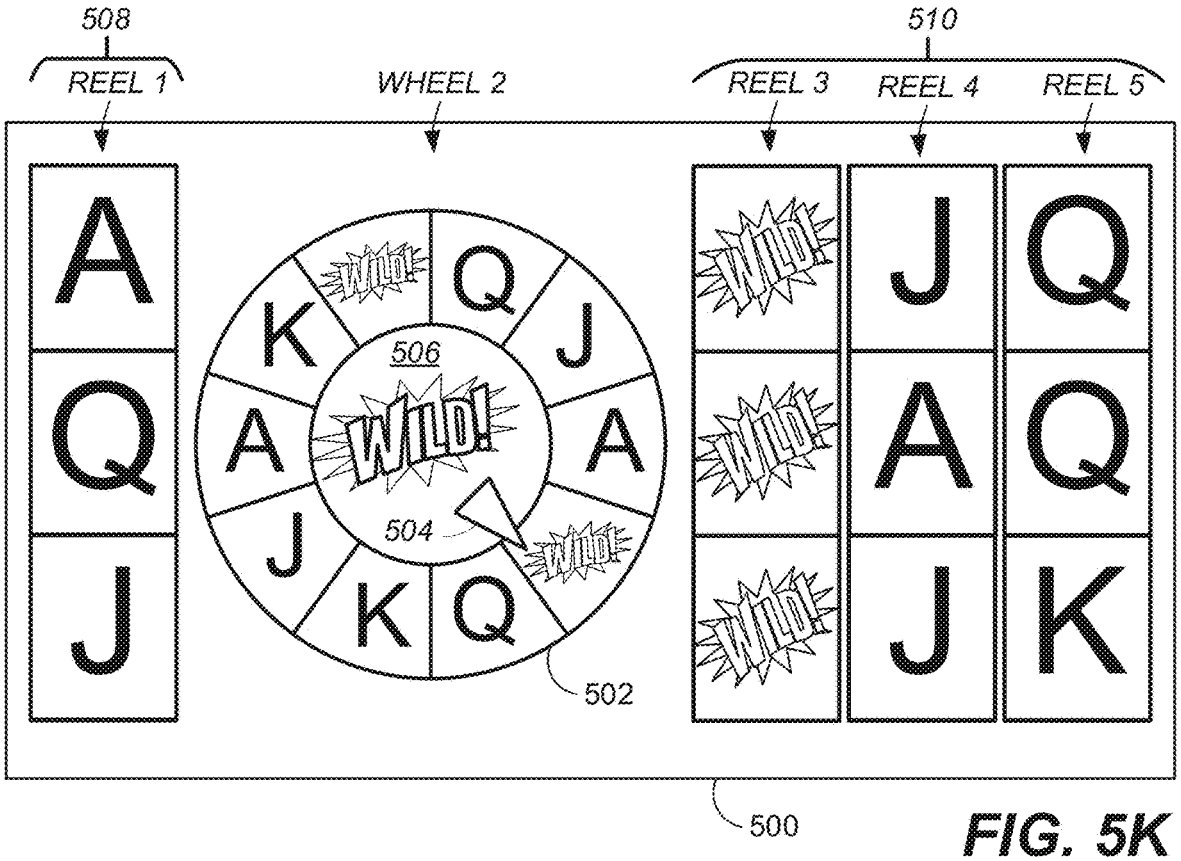

FIG. 5K is a block representation of an example display screen 500 illustrating that the wheel 502 can be in different positions such that different examples and different instances may include a different number of preceding and subsequent reels 508, 510. In at least one example the wheel 502 is never the first reel or the last reel. In the illustrated example the wheel 502 is positioned at the second reel position with one preceding reel 508 and three subsequent reels 510. In the illustrated example the game controller 202 has performed cross-symbol mapping to map the symbol outcome 506 to one subsequent reel (reel 3) of the subsequent reels 510. The illustrated example does not show the pay outcome.

Figure 6A:
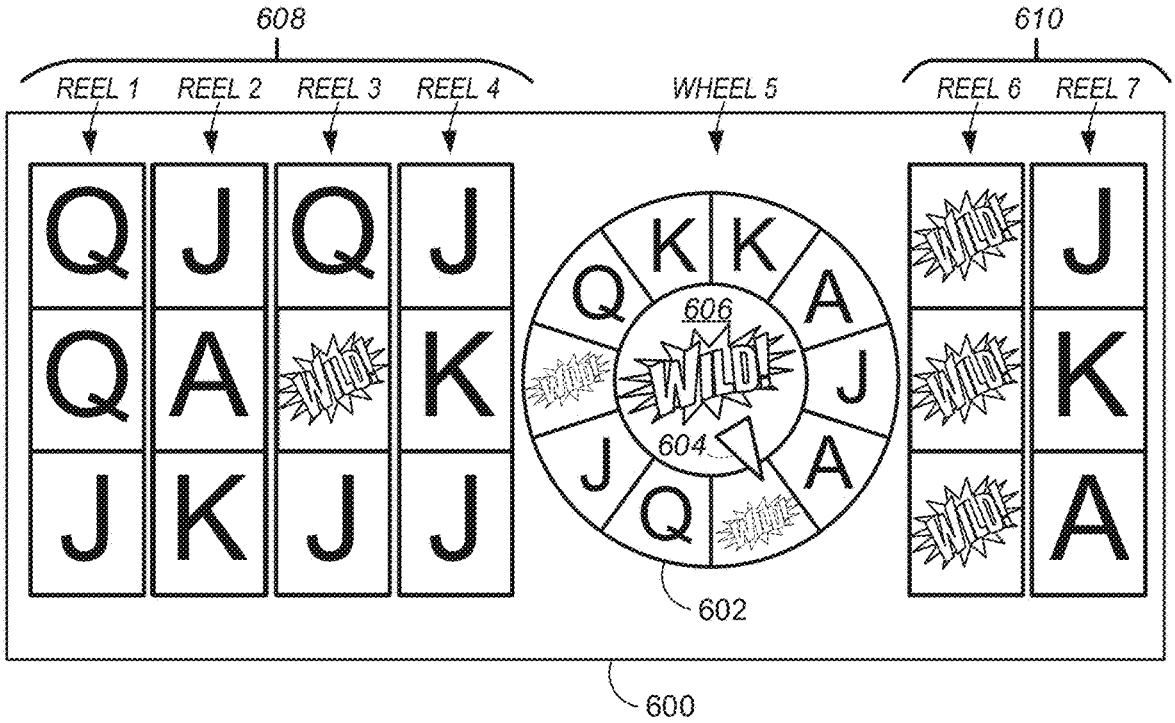
FIGS. 6A and 6B are block representations of example display screens integrating a wheel in a slot game having seven reel positions.
Figure 6B:
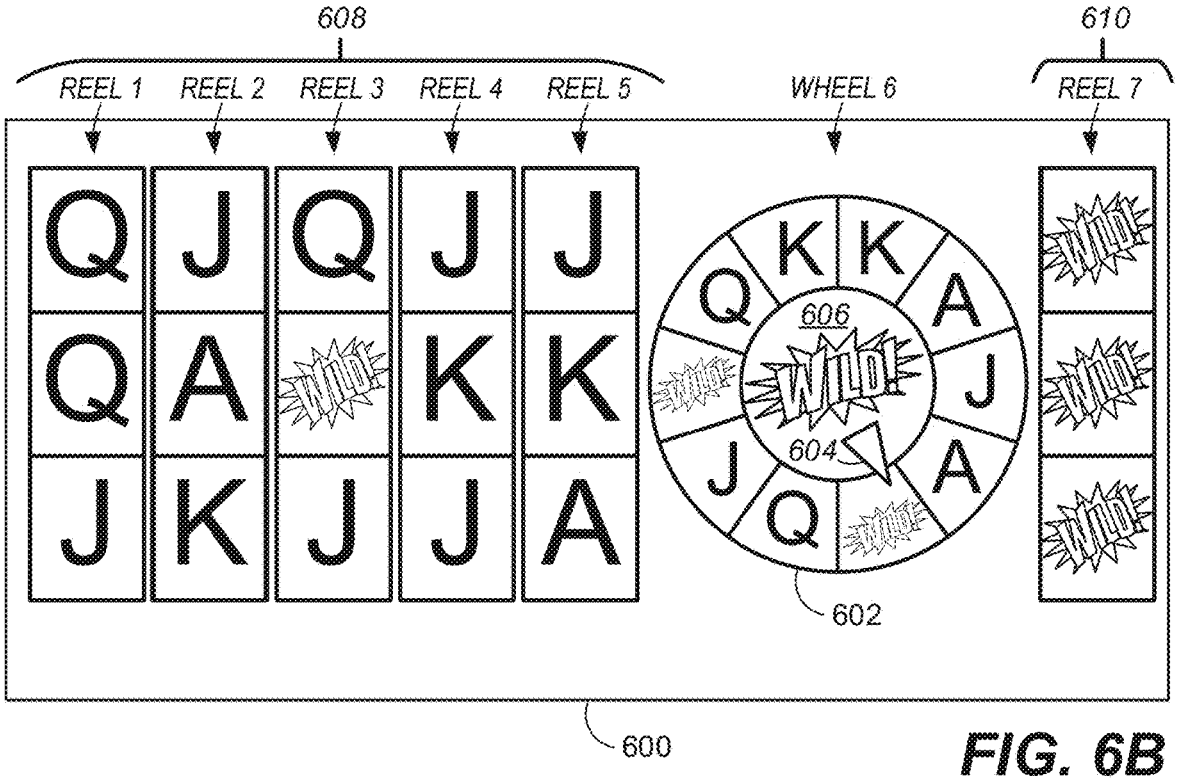

FIGS. 6A and 6B are block representations of example display screens 600 integrating a wheel 602 in a slot game having seven reel positions. FIG. 6A shows the wheel 602 in the fifth reel position with cross-symbol mapping occurring to Reel 6. FIG. 6B shows wheel 602 in the sixth reel position with cross-symbol mapping occurring to Reel 7. No pay outcome is shown in FIGS. 6A and 6B.

FIG. 7 is a block representation of an example display screen 700 integrating a static wheel layout 750 in a slot game. The static wheel layout includes slices 711, 712, 713, 714, 714, 715, 717 718, 719, 720 which may be filled with display symbols. In the illustrated example, the layout 750 includes two WILD symbols in specific slices 712, 716. The remaining slices, 711, 713, 714, 715, 717, 718, 719, 720 may be filled by dynamic mapping from the one or more preceding reels 708 and/or independently of the preceding reels 708. two Wild! Other examples can include more or less static display symbols for the slices 711-720. In at least one example, the game controller 202 uses a set of wheel layouts (e.g., 20 static wheel layouts). Each layout could be created to have a different expected value and the wheel pick could be based on a weighted table per game basis where wheel layouts with lower expected value will be weighted higher than wheel layouts with higher expected value. In such examples, the static wheel layouts can be used instead of dynamically populating the wheel. In some examples each wheel layout includes a WILD! so that a winner can potentially be created if the prior reels satisfy a paying combination.

Further, while the wheel is illustrated as two-dimensional, other examples could include a three-dimensional wheel. The wheel may be integrated as an always-on main or base game. In some examples the wheel only appears in bonus and/or secondary features. In some examples, the integrated wheel is provided as a surprise front screen bonus after hitting play (or spin). Such an example would require two or more base game layout templates.

Other non-limiting example configurations are described in the following individually numbered Examples.

In Example 1 a system includes a game controller including one or more processors. The game controller executes instructions which cause the game controller to determine a game outcome and perform a pay evaluation of the game outcome Determining the game outcome includes randomly determining, based on a first outcome from a random number generator, a first set of display symbols selected from a full symbol set to populate one or more preceding reels, the first set of display symbols representing one or more preceding reel outcomes. Determining the game outcome further includes determining a second set of display symbols to populate slices of a wheel, at least one display symbol of the second set of display symbols being selected from the first set of display symbols. Determining the game outcome further includes determining a symbol outcome for the wheel. Determining the game outcome further includes determining a third set of display symbols to populate one or more subsequent reels, the third set of display symbols representing one or more subsequent reel outcomes. The pay evaluation of the game outcome is performed based on applying the symbol outcome of the wheel positioned between the one or more preceding reel outcomes and the one or more subsequent reel outcomes.

In Example 2, the system of Example 1 is optionally configured such that executing the instructions further causes the game controller to control a display system to display the game outcome, including displaying the wheel positioned between the one or more preceding reels and the one or more subsequent reels, displaying the first set of display symbols at the one or more preceding reels, displaying the second set of display symbols at the wheel, displaying selection of the symbol outcome for the wheel, and displaying the third set of display symbols at the one or more subsequent reels.

In Example 3, the system of Example 1 or Example 2 is optionally configured such that the causing the game controller to determine the third set of display symbols includes causing the game controller to map the symbol outcome of the wheel to a subsequent reel of the one or more subsequent reels.

In Example 4, the system of any of Examples 1-3 is optionally configured such that executing the instructions further causes the game controller to determine a first number of preceding reels and a first number of subsequent reels to include in a first game instance, the game outcome being a first game instance outcome corresponding to the first game instance. Executing the instructions further causes the game controller to control a display system to display the wheel positioned between the first number of preceding reels and the first number of subsequent reels for the first game instance.

In Example 5, the system of Example 4 is optionally configured such that executing the instructions further causes the game controller to determine a second number of preceding reels different than the first number of preceding reels and a second number of subsequent reels different than the first number of subsequent reels to include in a second game instance. Executing the instructions further causes the game controller to control the display system to display the wheel positioned between the second number of preceding reels and the second number of subsequent reels for the second game instance.

In Example 6, the system of Example 5 is optionally configured such that the first and second numbers of preceding reels and the first and second numbers of subsequent reels are determined based on a predefined sequence for position of the wheel.

In Example 7, the system of Example 5 is optionally configured such that executing the instructions causes the game controller to determine the first and second numbers of preceding reels and the first and second numbers of subsequent reels based on a random selection of one of a plurality of potential positions of the wheel using the random number generator.

In Example 8, the system of any of Examples 1-7 is optionally configured such that causing the game controller to determine the symbol outcome for the wheel includes causing the game controller to assign uniform probability to the slices of the wheel and using the random number generator.

In Example 9, the system of any of Examples 1-8 is optionally configured such that causing the game controller to determine the symbol outcome for the wheel includes causing the game controller to assign non-uniform probability to the slices of the wheel and using a random number generator.

In Example 10, the system of any of Examples 1-9 is optionally configured such that causing the game controller to determine the second set of display symbols includes causing the game controller to dynamically map the first set of display symbols to the slices of the wheel.

In Example 11, the system of any of Examples 1-10 is optionally configured such that causing the game controller to determine the third set of display symbols includes causing the game controller to map the symbol outcome of the wheel to a subsequent reel of the one or more subsequent reels.

In Example 12, the system of any of Examples 1-11 is optionally configured such that causing the game controller to determine the second set of display symbols includes causing the game controller to use a lookup table to determine which display symbol populates on each of the slices of the wheel.

In Example 13, the system of any of Examples 1-12 is optionally configured such that causing the game controller to determine the second set of display symbols includes causing the game controller to select a layout of a plurality of static wheel layouts.

In Example 14, the system of the Example 13 is optionally configured such that each of the plurality of static wheel layouts has an expected value and executing the instructions cause the game controller to select the layout using the random number generator and a weighted table.

In Example 15, the system of any of Examples 1-14 is optionally configured such that causing the game controller to determine the second set of display symbols includes causing the game controller to assign the display symbols based on a weighted table and the random number generator.

In Example 16, the system of the Example 15 is optionally configured such that executing the instructions further causes the game controller to assign the display symbols based on criterion requiring at least one wild and no more than a predetermined number of a single display symbol.

In Example 17, the system of Example 15 is optionally configured such that executing the instructions further causes the game controller to assign the display symbols based on criterion requiring a predetermined number of slices between two matching display symbols.

In Example 18, the system of any of Examples 1-17 is optionally configured such that causing the game controller to determine the third set of display symbols includes causing the game controller to determine, on a random basis, whether to map the symbol outcome of the wheel to a subsequent reel of the one or more subsequent reels.

In Example 19, the system of any of Examples 1-18 further includes a player interface including a wheel actuator wherein the game controller is configured to control a display system to display movement of the wheel corresponding to movement of the wheel actuator.

In Example 20, the system of Example 19 is optionally configured such that the wheel actuator is a slingshot, a dial, or a wheel.

Example 21 provides a method of integrating a wheel between reels of a slot game comprising determining, by a game controller, a game outcome, performing, by a game controller, a pay evaluation of the game outcome, and controlling, by a game controller, the display system to display the game outcome; determining the game outcome includes determining a first set of display symbols selected from a full symbol set to populate one or more preceding reel, the first set of display symbols representing one or more preceding reel outcomes; determining the game outcome further includes determining a second set of display symbols to populate slices of a wheel, at least one display symbol of the second set of display symbols being selected from the first set of display symbols; determining the game outcome further includes determining a symbol outcome for the wheel; determining the game outcome further includes determining a third set of display symbols to populate one or more subsequent reels, the third set of display symbols representing one or more subsequent reel outcomes; performing the pay evaluation of the game outcome includes applying the symbol outcome of the wheel positioned between the one or more preceding reel outcomes and the one or more subsequent reel outcomes; controlling the display system to display the game outcome includes displaying the wheel positioned between the one or more preceding reels and the one or more subsequent reels; controlling the display system to display the game outcome includes displaying the first set of display symbols at the one or more preceding reels; controlling the display system to display the game outcome includes displaying the second set of display symbols at the wheel; controlling the display system to display the game outcome includes displaying selection of the symbol outcome for the wheel; controlling the display system to display the game outcome includes also includes displaying the third set of display symbols at the one or more subsequent reels.

Example 22 provides one or more non-transitory media having software stored thereon, the software including instructions for controlling one or more devices to perform a method the method comprising determining, by a game controller, a game outcome, performing, by a game controller, a pay evaluation of the game outcome, and controlling, by a game controller, the display system to display the game outcome; determining the game outcome includes determining a first set of display symbols selected from a full symbol set to populate one or more preceding reel, the first set of display symbols representing one or more preceding reel outcomes; determining the game outcome further includes determining a second set of display symbols to populate slices of a wheel, at least one display symbol of the second set of display symbols being selected from the first set of display symbols; determining the game outcome further includes determining a symbol outcome for the wheel; determining the game outcome further includes determining a third set of display symbols to populate one or more subsequent reels, the third set of display symbols representing one or more subsequent reel outcomes; performing the pay evaluation of the game outcome includes applying the symbol outcome of the wheel positioned between the one or more preceding reel outcomes and the one or more subsequent reel outcomes; controlling the display system to display the game outcome includes displaying the wheel positioned between the one or more preceding reels and the one or more subsequent reels; controlling the display system to display the game outcome includes displaying the first set of display symbols at the one or more preceding reels; controlling the display system to display the game outcome includes displaying the second set of display symbols at the wheel; controlling the display system to display the game outcome includes displaying selection of the symbol outcome for the wheel; controlling the display system to display the game outcome includes also includes displaying the third set of display symbols at the one or more subsequent reels.

While the disclosure has been described with respect to the figures, it will be appreciated that many modifications and changes may be made by those skilled in the art without departing from the spirit of the disclosure. Any variation and derivation from the above description and figures are included in the scope of the present disclosure as defined by the claims.

What is claimed is:

1. A system, comprising:

a game controller comprising one or more processors, the game controller executing instructions which cause the game controller to:

obtain, by a random number generator, a first outcome;

apply the first outcome to one or more lookup tables to obtain a first set of display symbols for a plurality of display positions associated with a first one or more reels;

present, on a first reel portion of a user interface, the first set of display symbols in accordance with the plurality of display positions associated with the first one or more reels;

present, on a wheel portion of the user interface, a second set of display symbols in association with corresponding slices of a wheel, wherein at least one display symbol of the second set of display symbols is among the first set of display symbols;

obtain, by the random number generator, a second outcome;

apply the second outcome to the second set of display symbols to obtain a symbol outcome for the wheel;

present a second reel portion of the user interface, wherein the wheel portion of the user interface is displayed between the first reel portion and the second reel portion; and present, on the second reel portion of the user interface, a third set of display symbols at the one or more subsequent reel positions, wherein a win path for the user interface is determine a result based on a display position of a win path that includes a set of display symbols present on the user interface that traverses the first one or more preceding reel outcomes, followed by the symbol outcome of the wheel, followed by the second one or more reel outcomes.

2. The system of claim 1, wherein the third set of display symbols are obtained by mapping the symbol outcome of the wheel to a subsequent reel of the second reel portion.

3. The system of claim 1, wherein executing the instructions further causes the game controller to:

determine a first number of reels in the first set of reels and a second number reels of the second set of reels for a first game instance; and control a display system to display the wheel positioned between the first set of reels and the second set of reels in accordance with the first number of reels and the second number of reels for the first game instance.

4. The system of claim 3, wherein executing the instructions further causes the game controller to:

determine a third number of reels of the first set of reels different than the first number of reels, and a fourth number of reels of the second set of reels different than the second number of reels for a second game instance; and control a display system to display the wheel positioned between the first set of reels and the second set of reels in accordance with the third number of reels and the second number of reels for the second game instance.

5. The system of claim 4, wherein the first and second numbers of reels are determined based on a predefined sequence for position of the wheel.

6. The system of claim 4, wherein executing the instructions causes the game controller to determine the first and second numbers of reels based on a random selection of one of a plurality of potential positions of the wheel using the random number generator.

7. The system of claim 1, wherein the slices of the wheel are assigned uniform probability using the random number generator.

8. The system of claim 1, wherein the slices of the wheel are assigned non-uniform probability using the random number generator.

9. The system of claim 1, further comprising causing the game controller to dynamically map the first set of display symbols to the slices of the wheel.

10. The system of claim 9, further comprising causing the game controller to map the symbol outcome of the wheel to a subsequent reel of the second set of reels.

11. The system of claim 1, wherein causing the game controller to determine the second set of display symbols includes causing the game controller to use a lookup table to determine which display symbol populates on each of the slices of the wheel.

12. The system of claim 1, wherein causing the game controller to determine the second set of display symbols includes causing the game controller to assign the display symbols based on a weighted table and the random number generator.

13. The system of claim 12, wherein executing the instructions further cause the game controller to assign the display symbols based on criterion requiring at least one wild and no more than a predetermined number of a single display symbol.

14. The system of claim 12, wherein executing the instructions further cause the game controller to assign the display symbols based on criterion requiring a predetermined number of slices between two matching display symbols.

15. The system of claim 1, further comprising:

a player interface including a wheel actuator, wherein the game controller is configured to control a display system to display movement of the wheel corresponding to movement of the wheel actuator.

16. A non-transitory computer readable medium comprising computer readable code executable by one or more processors to:

obtain, by a random number generator, a first outcome;

apply the first outcome to one or more lookup tables to obtain a first set of display symbols for a plurality of display positions associated with a first one or more reels;

provide, for presentation on a first reel portion of a user interface, the first set of display symbols in accordance with the plurality of display positions associated with the first one or more reels;

provide, for presentation on a wheel portion of the user interface, a second set of display symbols in association with corresponding slices of a wheel, wherein at least one display symbol of the second set of display symbols is among the first set of display symbols;

obtain, by the random number generator, a second outcome;

apply the second outcome to the second set of display symbols to obtain a symbol outcome for the wheel; and provide, for presentation, a second reel portion of the user interface, wherein the wheel portion of the user interface is displayed between the first reel portion and the second reel portion; and provide, for presentation on the second reel portion of the user interface, a third set of display symbols at the one or more subsequent reel positions, wherein a win path for the user interface is based on a display position of a win path that includes a set of display symbols present on the user interface that traverses the first one or more preceding reel outcomes, followed by the symbol outcome of the wheel, followed by the second one or more reel outcomes.

17. The non-transitory computer readable medium of claim 16, wherein the third set of display symbols are obtained by mapping the symbol outcome of the wheel to a subsequent reel of the second reel portion.

18. The non-transitory computer readable medium of claim 16, further comprising computer readable code to:

determine a first number of reels in the first set of reels and a second number reels of the second set of reels for a first game instance; and control a display system to display the wheel positioned between the first set of reels and the second set of reels in accordance with the first number of reels and the second number of reels for the first game instance.

19. The non-transitory computer readable medium of claim 18, further comprising computer readable code to:

determine a third number of reels of the first set of reels different than the first number of reels, and a fourth number of reels of the second set of reels different than the second number of reels for a second game instance; and control a display system to display the wheel positioned between the first set of reels and the second set of reels in accordance with the third number of reels and the second number of reels for the second game instance.

20. The non-transitory computer readable medium of claim 19, wherein the first and second numbers of reels are determined based on a predefined sequence for position of the wheel.

* * * * *